US006910009B1

(12) United States Patent
Murashima

(10) Patent No.: US 6,910,009 B1
(45) Date of Patent: Jun. 21, 2005

(54) SPEECH SIGNAL DECODING METHOD AND APPARATUS, SPEECH SIGNAL ENCODING/DECODING METHOD AND APPARATUS, AND PROGRAM PRODUCT THEREFOR

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 747 days.

(21) Appl. No.: 09/699,435

(22) Filed: Oct. 31, 2000

(30) Foreign Application Priority Data

Nov. 1, 1999 (JP) ..... 11-311620

(51) Int. Cl.[7] ..... G10L 19/14; G10L 19/12
(52) U.S. Cl. ..... 704/225; 704/223
(58) Field of Search ..... 704/220, 223, 704/224, 225, 233

(56) References Cited

U.S. PATENT DOCUMENTS

| | | | | |
|---|---|---|---|---|
| 5,267,317 A | | 11/1993 | Kleijn | |
| 5,664,055 A | * | 9/1997 | Kroon | 704/223 |
| 5,960,389 A | * | 9/1999 | Jarvinen et al. | 704/220 |
| 6,202,046 B1 | * | 3/2001 | Oshikiri et al. | 704/233 |
| 6,453,289 B1 | * | 9/2002 | Ertem et al. | 704/225 |
| 6,507,814 B1 | * | 1/2003 | Gao | 704/220 |

FOREIGN PATENT DOCUMENTS

| | | |
|---|---|---|
| CA | 2317969 A1 | 3/2001 |
| EP | 0 731 348 A2 | 9/1996 |

OTHER PUBLICATIONS

"Efficient Excitation Modeling in a Low Bit–Rate CELP Coder"; Copperi, M.; 1991. ICASSP–91., 1991 International Conference on , Apr. 14–17, 1991; pp.: 233–236 vol. 1.*

Schroeder et al., "Code–Excited Linear Prediction (CELP): High–Quality Speech at Very Low Bit Rates", *Proc. of IEEE Int. Conf. on Acoust., Speech and Signal Processing,* 1985, pp. 937–940.

"Digital Cellular Telecommunication System; Adaptive Multi–Rate Speech Transcoding", *ETSI Technical Report,* GSM 06.90 version 2.0.0., Jan. 1999.

Rabiner et al., "Digital Processing of Speech Signals", *Prentice–Hall, Inc.,* 1978, pp. 396–419.

E. Ekudden et al., "The Adaptive Multi–Rate Speech Coder", Speech Coding Proceedings, 1999 IEEE Workshop on Porvoo, Jun. 20, 1999, pp. 117–119 with Abstract.

* cited by examiner

*Primary Examiner*—Susan McFadden
*Assistant Examiner*—James S. Wozniak
(74) *Attorney, Agent, or Firm*—Sughrue Mion, PLLC

(57) ABSTRACT

The quality of reconstructed speech on which background noise is superimposed is improved in a speech signal decoding apparatus for generating a speech signal by driving a filter, which is constituted by linear prediction coefficients, by an excitation signal. A smoothing circuit smoothes sound source gain in a noise segment using sound source gain that was obtained in the past. A smoothing-quantity limiting circuit calculates an amount of fluctuation represented by dividing, by the sound source gain, the absolute value of the difference between the sound source gain and the sound source gain that has been smoothed, and limits the value of the smoothed gain in such a manner that the amount of fluctuation will not exceed a certain threshold value.

48 Claims, 9 Drawing Sheets

SPEECH SIGNAL DECODING METHOD AND APPARATUS, SPEECH SIGNAL ENCODING/DECODING METHOD AND APPARATUS, AND PROGRAM PRODUCT THEREFOR

FIELD OF THE INVENTION

This invention relates to a method of encoding and decoding a speech signal at a low bit rate. More particularly, the invention relates to a speech signal decoding method and apparatus, a speech signal encoding/decoding method and apparatus and a program product for improving the quality of sound in noise segments.

BACKGROUND OF THE INVENTION

A method of encoding a speech signal by separating the speech signal into a linear prediction filter and its driving excitation signal (excitation signal, excitation vector) is used widely as a method of encoding a speech signal efficiently at medium to low bit rates. One such method that is typical is CELP (Code-Excited Linear Prediction). With CELP, a linear prediction filter for which linear prediction coefficients representing the frequency characteristic of input speech have been set is driven by an excitation signal (excitation vector) represented by the sum of a pitch signal (pitch vector), which represents the pitch period of speech, and a sound source signal (sound source vector) comprising a random number or a pulse train, whereby there is obtained a synthesized speech signal (reconstructed signal, reconstructed vector). At this time the pitch signal and the sound source signal are multiplied by respective gains (pitch gain and sound source gain). For a discussion of CELP, see the paper (referred to as "Reference 1") "Code excited linear prediction: High quality speech at very low bit rates" by M. Schroeder et. al (Proc. of IEEE Int. Conf. on Acoust., Speech and Signal Processing, pp. 937–940, 1985).

Mobile communication such as by cellular telephone requires good quality in a noisy environment typified by the congestion of busy streets and by the interior of a traveling automobile. A problem with CELP-based speech encoding is a marked decline in sound quality for speech on which noise has been superimposed (such speech will be referred to as "background-noise speech" below).

A method of smoothing the gain of a sound source in a decoder is an example of a known technique for improving the encoded speech quality of background-noise speech. In accordance with this method, a temporal change in short-term average power of a sound source signal that has been multiplied by the aforesaid sound source gain is smoothed by smoothing the sound source gain. As a result, a temporal change in short-term average power of the excitation signal also is smoothed. This method improves sound quality by reducing extreme fluctuation in short-term average power in decoded noise, which is one cause of degraded sound quality.

With regard to a method of smoothing the gain of a sound source signal, see Section 6.1 of "Digital Cellular Telecommunication System; Adaptive Multi-Rate Speech Transcoding" (ETSI Technical Report, GSM 06.90 version 2.0.0) (Referred to as "Reference 2").

FIG. 8 is a block diagram illustrating an example of the structure of a conventional speech signal decoder which improves the encoded quality of background-noise speech by smoothing the gain of a sound source signal. It is assumed here that input of a bit sequence occurs in a period (frame) of $T_{fr}$ msec (e. g., 20 ms) and that computation of a reconstructed vector is performed in a period (subframe) of $T_{fr}/N_{sfr}$ msec (e. g., 5 ms), where $N_{sfr}$ is an integer (e. g., 4). Let frame length be $L_{fr}$ samples (e. g., 320 samples) and let subframe length be $L_{sfr}$ samples (e. g., 80 samples). The numbers of these samples is decided by the sampling frequency (e. g., 16 kHz) of the input speech signal.

The components of the conventional speech signal decoder will be described with reference to FIG. 8.

The code of the bit sequence enters from an input terminal 10. A code input circuit 1010 splits the code of the bit sequence that has entered from the input terminal 10 and converts it to indices that correspond to a plurality of decode parameters. An index corresponding to a line spectrum pair (LSP) which represents the frequency characteristic of the input signal is output to an LSP decoding circuit 1020, an index corresponding to a delay $L_{pd}$ that represents the pitch period of the input signal is output to a pitch signal decoding circuit 1210, an index corresponding to a sound source vector comprising a random number or a pulse train is output to sound source signal decoding circuit 1110, an index corresponding to a first gain is output to a first gain decoding circuit 1220, and an index corresponding to a second gain is output to a second gain decoding circuit 1120.

The LSP decoding circuit 1020 has a table (not shown) in which multiple sets of LSPs have been stored. The LSP decoding circuit 1020 receives as an input the index that is output from the code input circuit 1010, reads the LSP that corresponds to this index out of the table and obtains LSP $\hat{q}_j^{(Nsfr)}(n)$ in the $N_{sfr}$th subframe of the present frame (the nth frame), where $N_p$ represents the degree of linear prediction.

The LSP of an $(N_{sfr}-1)$th subframe from the first subframe is obtained by linearly interpolating $\hat{q}_j^{(Nsfr)}(n)$ and $S_{sfr}(i)$ (where $i=0, \ldots, L_{sf}$).

LSP $\hat{q}_j^{(Nsfr)}(n)$ (where $j=1, \ldots, Np$, $m=1, \ldots, N_{sfr}$) is output to a linear prediction coefficient conversion circuit 1030 and to a smoothing coefficient calculation circuit 1310.

The linear prediction coefficient conversion circuit 1030 receives as an input a signal output from the LSP $\hat{q}_j^{(m)}(n)$ (where $j=1, \ldots, Np$, $m=1, \ldots, N_{sfr}$) decoding circuit 1020.

The linear prediction coefficient conversion circuit 1030 converts the entered LSP $\hat{q}_j^{(m)}(n)$ to a linear prediction coefficient $\hat{\alpha}_j^{(m)}(n)$ (where $j=1, \ldots, Np$, $m=1, \ldots, N_{sfr}$) and outputs $\hat{\alpha}_j^{(m)}(n)$ to a synthesis filter 1040. A known method such as the one described in Section 5.2.4 of Reference 2 is used to convert the LSP to a linear prediction coefficient.

The sound source signal decoding circuit 1110 has a table (not shown) in which a plurality of sound source vectors have been stored. The sound source signal decoding circuit 1110 receives as an input the index that is output from the code input circuit 1010, reads the sound source vector that corresponds to this index out of the table and outputs this vector to a second gain circuit 1130.

The second gain decoding circuit 1120 has a table (not shown) in which a plurality of gains have been stored. The second gain decoding circuit 1120 receives as an input the index that is output from the code input circuit 1010, reads a second gain that corresponds to this index out of the table and outputs this gain to a smoothing circuit 1320.

The second gain circuit 1130, which receives as inputs the first sound source vector output from the sound source signal decoding circuit 1110 and the second gain output from the smoothing circuit 1320, multiplies the first sound source vector by the second gain to generate a second sound source vector and outputs the second sound source vector to an adder 1050.

A memory circuit 1240 holds an excitation vector input thereto from the adder 1050. The memory circuit 1240, which holds the excitation vector applied to it in the past, outputs the vector to a pitch signal decoding circuit 1210.

The pitch signal decoding circuit 1210 receives as inputs the past excitation vector held by the memory circuit 1240 and the index output from the code input circuit 1010. The index specifies a delay $L_{pd}$. In regard to this past excitation vector, the pitch signal decoding circuit 1210 cuts vectors of $L_{sfr}$ samples corresponding to the vector length from a point $L_{pd}$ samples previous to the starting point of the present frame and generates a first pitch signal (vector). In case of $\hat{\alpha}_j^{(m)}(n)$, the pitch signal decoding circuit 1210 cuts out vectors of $L_{pd}$ samples, repeatedly connects the $L_{pd}$ samples and generates a first pitch vector, which is a sample of vector length $L_{sfr}$. The pitch signal decoding circuit 1210 outputs the first pitch vector to a first gain circuit 1230.

The first gain decoding circuit 1220 has a table (not shown) in which a plurality of gains have been stored. The first gain decoding circuit 1220 receives as an input the index that is output from the code input circuit 1010, reads a first gain that corresponds to this index out of the table and outputs this gain to the first gain circuit 1230.

The first gain circuit 1230, which receives as inputs the first pitch vector output from the pitch signal decoding circuit 1210 and the first gain output from the first gain decoding circuit 1220, multiplies the entered first pitch vector by the first gain to generate a second pitch vector and outputs the generated second pitch vector to the adder 1050.

The adder 1050, to which the second pitch vector output from the first gain circuit 1230 and the second sound source vector output from the second gain circuit 1130 are input, adds these inputs and outputs the sum to the synthesis filter 1040 as an excitation vector.

The smoothing coefficient calculation circuit 1310, to which LSP $\hat{q}_j^{(m)}(n)$ output from the LSP decoding circuit 1020 is input, calculates an average LSP $q_{0j}(n)$ in the nth frame in accordance with Equation (1) below.

$$\hat{q}_{0j}(n)=0.84\cdot\bar{q}_{0j}(n-1)+0.16\cdot\hat{q}_{0j}^{(N_{sfr})}(n) \tag{1}$$

Next, with respect to each subframe m, the smoothing coefficient calculation circuit 1310 calculates the amount of fluctuation $d_0(m)$ of the LSP in accordance with Equation (2) below.

$$d_0(m)=\sum_{j=1}^{N_0}\frac{|\bar{q}_{0j}(n)-\hat{q}_j^{(m)}(n)|}{\bar{q}_{0j}(n)} \tag{2}$$

A smoothing coefficient $k_0(m)$ in the subframe m is calculated in accordance with Equation (3) below.

$$k_0(m)=\min\ (0.25,\ \max\ (0,\ d_0(m)-0.4))/0.25 \tag{3}$$

where min(x, y) is a function in which the smaller of x and y is taken as the value and max(x, y) is a function in which the larger of x and y is taken as the value. The smoothing coefficient calculation circuit 1310 finally outputs the smoothing coefficient $k_0(m)$ to the smoothing circuit 1320.

The smoothing coefficient $k_0(m)$ output from the smoothing coefficient calculation circuit 1310 and the second gain output from the second gain decoding circuit 1120 are input to the smoothing circuit 1320. The latter then calculates an average gain $g_0(m)$ in accordance with Equation (4) below from second gain $\hat{g}_0(m)$ in subframe m.

$$\bar{g}_0(m)=\frac{1}{5}\sum_{i=0}^{4}\hat{g}_0(m-i) \tag{4}$$

Next, second gain $\hat{g}_0(m)$ is substituted in accordance with Equation (5) below.

$$\hat{g}_0(m)=\hat{g}_0\cdot k_0(m)+\bar{g}_0(m)\cdot(1-k_0(m)) \tag{5}$$

Finally the smoothing circuit 1320 outputs the second gain $\hat{g}_0(m)$ to the second gain circuit 1130.

The excitation vector output from the adder 1050 and the linear prediction coefficient $\hat{\alpha}_j^{(m)}(n)$ (where j=1, . . . , Np, m=1, . . . , $N_{sfr}$) output from the linear prediction coefficient conversion circuit 1030 are input to the synthesis filter 1040. The latter drives a synthesis filter 1/A(z), for which the linear prediction coefficients have been set, by the excitation vector to thereby calculate the reconstructed vector, which is output from an output terminal 20. The transfer function 1/A(z) of the synthesis filter is represented by Equation (6) below, where it is assumed that the linear prediction coefficient is represented by $\alpha_i$ (i=1, . . . , $N_p$).

$$1/A(z)=1\Big/\left(1-\sum_{i=1}^{N_0}\alpha_i z^i\right) \tag{6}$$

FIG. 9 is a block diagram illustrating the structure of a speech signal encoder in a conventional speech signal encoding/decoding apparatus. The speech signal encoder will be described with reference to FIG. 9. It should be noted that the first gain circuit 1230, the second gain circuit 1130, the adder 1050 and the memory circuit 1240 are the same as those described in connection with the speech signal decoding apparatus shown in FIG. 8 and need not be described again.

The encoder has an input terminal 30 to which an input signal (input vector) is applied, the input vector being generated by sampling a speech signal and combining a plurality of samples into one vector as one frame.

The input vector from the input terminal 30 is applied to a linear prediction coefficient calculation circuit 5510, which proceeds to subject the input vector to linear prediction analysis and obtain linear prediction coefficients. A known method of performing linear prediction analysis is described in Chapter 8 "Linear Predictive Coding of Speech" in L. R. Rabiner et. al "Digital Processing of Speech Signals" (Prentice-Hall, 1978) (referred to as "Reference 3").

The linear prediction coefficient calculation circuit 5510 outputs the linear prediction coefficients to an LSP conversion/quantization circuit 5520.

Upon receiving the linear prediction coefficients output from the linear prediction coefficient calculation circuit 5510, the LSP conversion/quantization circuit 5520 converts the linear prediction coefficients to an LSP and quantizes the LSP to obtain a quantized LSP. An example of a well-known method of converting linear prediction coefficients to an LSP is that described in Section 5.2.3 of Reference 2. An example of a method of quantizing an LSP is that described in Section 5.2.5 of Reference 2.

As described in connection with the LSP decoding circuit of FIG. 8, the quantized LSP is assumed to be a quantized LSP $\hat{q}_j^{(N_{sfr})}(n)$ in the $N_{sfr}$th subframe of the present frame (the nth frame) (where j=1, . . . Np).

The quantized LSP of an $(N_{sfr}-1)$th subframe from the first subframe is obtained by linearly interpolating $\hat{q}_j^{(Nsfr)}(n)$ and $S_{sfr}(i)$ (where j=1, . . . , Lsf). Furthermore, this LSP is assumed to be LSP $q_j^{(Nsfr)}(n)$ (j=1, . . . Np) in the $N_{sfr}$th subframe of the present frame (the nth frame). The LSP of the $(N_{sfr}-1)$th subframe from the first subframe is obtained by linearly interpolating $q_j^{(Nsfr)}(n)$ and $q_j^{(Nsfr)}(n-1)$.

The LSP conversion/quantization circuit 5520 outputs $LSPq_j^{(m)}(n)$ (where j=1, . . . , Np, m=1, . . . , $N_{sfr}$) and the quantized LSP $\hat{q}_j^{(m)}(n)$ (where j=1, . . . , Np, m=1, . . . , $N_{sfr}$) to a linear prediction coefficient conversion circuit 5030 and outputs an index corresponding to the quantized LSP $\hat{q}_j^{(Nsfr)}(n)$ (where j=1, . . . , Np) to a code output circuit 6010.

The LSP $q_j^{(m)}(n)$ (where j=1, . . . , Np, m=1, . . . , $N_{sfr}$) and the quantized LSP $\hat{q}_j^{(m)}(n)$ (where j=1, . . . , Np, m=1, . . . , $N_{sfr}$) output from the LSP conversion/quantization circuit 5520 are input to the linear prediction coefficient conversion circuit 5030, which proceeds to convert $q_j^{(m)}(n)$ to a linear prediction (LP) coefficient $\alpha_j^{(m)}(n)$ (where j=1, . . . , Np, m=1, . . . , $N_{sfr}$), convert $\alpha_j^{(m)}(n)$ to a linear prediction coefficient $\hat{\alpha}_j^{(m)}(n)$ (where j=1, . . . , Np, m=1, . . . , $N_{sfr}$), output the linear prediction coefficient $\alpha_j^{(m)}(n)$ to a weighting filter 5050 and to a weighting synthesis filter 5040, and output the linear prediction coefficient $\hat{\alpha}_j^{(m)}(n)$ to the weighting synthesis filter 5040.

An example of a well-known method of converting an LSP to linear prediction (LP) coefficients and converting a quantized LSP to quantized linear prediction coefficients is that described in Section 5.2.4 of Reference 2.

The input vector from the input terminal 30 and the linear prediction coefficients from the linear prediction coefficient conversion circuit 5030 are input to the weighting filter 5050. The latter uses these linear prediction coefficients to produce a weighting filter W(z) corresponding to the characteristic of the human sense of hearing and drives this weighting filter by the input vector, whereby there is obtained a weighted input vector. The weighted input vector is output to subtractor 5060. The transfer function W(z) of the weighting filter is represented by Equation (7) below.

$$W(z)=Q(z/r_1)/Q(z/r_2) \tag{7}$$

where the following holds.

$$Q(z/r_1) = 1 - \sum_{i=1}^{N_0} \alpha_i^{(m)} r_1^i z^i \tag{8}$$

$$Q(z/r_2) = 1 - \sum_{i=1}^{N_0} \alpha_i^{(m)} r_2^i z^i$$

Here $r_1$ and $r_2$ represent constants, e. g., $r_1$=0.9, $r_2$=0.6. Refer to Reference 1, etc., for the details of the weighting filter.

The excitation vector output from the adder 1050 and the linear prediction coefficient $\alpha_j^{(m)}(n)$ (where j=1, . . . , Np, m=1, . . . , $N_{sfr}$) and the linear prediction coefficient $\hat{\alpha}_j^{(m)}(n)$ (where j=1, . . . , Np, m=1, . . . , $N_{sfr}$) output from the linear prediction coefficient conversion circuit 5030 are input to the weighting synthesis filter 5040.

The weighting synthesis filter 5040 drives the weighting synthesis filter for which $\alpha_j^{(m)}(n)$, $\hat{\alpha}_j^{(m)}(n)$ have been set, namely $$H(z)W(z)=Q(z/r_1)/[A(z)Q(z/r_2)] \tag{9}$$

by the above-mentioned excitation vector, whereby a weighted reconstructed vector is obtained.

The transfer function H(Z)=1/A(z) of the synthesis filter is represented by Equation (10) below.

$$1/A(z) = 1 \Big/ \left(1 - \sum_{i=1}^{N_0} \hat{\alpha}_i^{(m)} z^i\right) \tag{10}$$

The weighted input vector output from the weighting filter 5050 and the weighted reconstructed vector output from the weighting synthesis filter 5040 are input to the subtractor 5060. The latter calculates the difference between these vectors and outputs the difference to a minimizing circuit 5070 as a difference vector.

The minimizing circuit 5070 successively outputs indices corresponding to all sound source vectors that have been stored in a sound source signal generating circuit 5110 to the sound source signal generating circuit 5110, successively outputs indices corresponding to all delays $L_{pd}$ within a range stipulated in a pitch signal generating circuit 5210 to the pitch signal generating circuit 5210, successively outputs indices corresponding to all first gains that have been stored in a first gain generating circuit 6220 to the first gain generating circuit 6220, and successively outputs indices corresponding to all second gains that have been stored in a second gain generating circuit 6120 to the second gain generating circuit 6120.

Further, difference vectors output from the subtractor 5060 successively enter the minimizing circuit 5070. The latter calculates the norms of these vectors, selects a sound source vector, a delay $L_{pd}$, a first gain and a second gain that will minimize the norms and outputs indices corresponding to these to the code output circuit 6010. The indices output from the minimizing circuit 5070 successively enter the pitch signal generating circuit 5210, the sound source signal generating circuit 5110, the first gain generating circuit 6220 and the second gain generating circuit 6120.

With the exception of wiring (connections) relating to input and output, the pitch signal generating circuit 5210, the sound source signal generating circuit 5110, the first gain generating circuit 6220 and the second gain generating circuit 6120 are identical with the pitch signal decoding circuit 1210, the sound source signal decoding circuit 1110, the first gain decoding circuit 1220 and the second gain decoding circuit 1120 shown in FIG. 8. Accordingly, these circuits need not be explained again.

The index corresponding to the quantized LSP output from the LSP conversion/quantization circuit 5520 is input to the code output circuit 6010, and so are the indices, which are output from the minimizing circuit 5070, corresponding to the sound source vector, the delay $L_{pd}$, the first gain and the second gain. The code output circuit 6010 converts these indices to the code of a bit sequence and outputs the code from an output terminal 40.

SUMMARY OF THE DISCLOSURE

In the course of eager investigations toward the present invention, various problems have been encountered.

A problem with the conventional coder and decoder described above is that there are instances where an abnormal sound is produced in noise segments when the sound source gain (the second gain) is smoothed. This is because the sound source gain smoothed in the noise segments may take on a value that is much larger than the sound source gain before smoothing.

The reason for this is that since there are cases where the sound source gain is smoothed even in a speech segment, it so happens that when a sound source gain obtained in the past is used to temporally smooth the first-mentioned sound source gain in a noise segment, the influence of a gain having a large value that corresponds to a past speech segment becomes a factor.

Accordingly, an object of the present invention in one aspect thereof is to provide an apparatus and method, and a program product as well as a medium on which the related program has been recorded, through which it is possible to avoid the occurrence of abnormal sound in noise segments, such sound being caused when, in the smoothing of sound source gain (the second gain), the sound source gain smoothed in a noise segment takes on a value much larger than that of the sound source gain before smoothing.

According to a first aspect of the present invention, there is provided a speech signal decoding method according to claim 1. The speech signal decoding method for decoding information concerning at least a sound source signal, gain and linear prediction coefficients from a received signal, generating an excitation signal and linear prediction coefficients from decoded information, and driving a filter, which is constituted by the linear prediction coefficients, by the excitation signal to thereby decode a speech signal, comprises: a first step of smoothing the gain using a past value of the gain; a second step of limiting the value of the smoothed gain based upon an amount of fluctuation calculated from the gain and the smoothed gain; and a third step of decoding the speech signal using the gain that has been smoothed and limited.

According to a second aspect of the present invention, there is provided a speech signal decoding method for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal, comprising: a first step of driving a norm of the excitation signal at regular intervals; a second step of smoothing the norm using a past value of the norm; a third step of limiting the value of the smoothed norm based upon an amount of fluctuation calculated from the norm and the smoothed norm; a fourth step of changing the amplitude of the excitation signal in the intervals using the norm and the norm that has been smoothed and limited; and a fifth step of driving the filter by the excitation signal the amplitude of which has been changed.

According to a third aspect of the present invention, there is provided a speech signal decoding method for decoding information concerning an excitation signal and linear prediction coefficients from a received signal, generating the excitation signal and the linear prediction coefficients from the decoded information, and driving a filter, which is constituted by the linear prediction coefficients, by the excitation signal to thereby decode a speech signal, comprising a first step of identifying a speech segment and a noise segment with regard to the received signal using the decoded information; a second step of deriving a norm of the excitation signal at regular intervals in the noise segment; a third step of smoothing the norm using a past value of the norm; a fourth step of limiting the value of the smoothed norm based upon an amount of fluctuation derived from the norm and the smoothed norm; a fifth step of changing the amplitude of the excitation signal in the intervals using the norm and the norm that has been smoothed and limited; and a sixth step of driving the filter by the excitation signal the amplitude of which has been changed.

According to a fourth aspect of the present invention, in the first aspect of the invention the amount of fluctuation is represented by dividing an absolute value of a difference between the gain and the smoothed gain by the gain, and the value of the smoothed gain is limited in such a manner that the amount of fluctuation will not exceed a certain threshold value.

According to a fifth aspect of the present invention, in the second and third aspects of the invention the amount of fluctuation is represented by dividing an absolute value of a difference between the norm and the smoothed norm by the norm, and the value of the smoothed norm is limited in such a manner that the amount of fluctuation will not exceed a certain threshold value.

According to a sixth aspect of the present invention, in the second, third or fifth aspect of the invention the excitation signal in the intervals is divided by the norm in the intervals and the quotient is multiplied by the smoothed norm in the intervals to thereby change the amplitude of the excitation signal.

According to a seventh aspect of the present invention, in the second or third aspect of the invention switching between use of the gain and use of the smoothed gain is performed in accordance with an entered switching control signal when the speech signal is decoded.

According to an eighth aspect of the present invention, in the second, third, fifth or sixth aspect of the invention switching between use of the excitation signal and use of the excitation signal the amplitude of which has been changed is performed in accordance with an entered switching control signal when the speech signal is decoded.

According to a ninth aspect of the present invention, there is provided a speech signal encoding and decoding method comprising encoding an input speech signal by expressing it by an excitation signal and linear prediction coefficients, and performing decoding by the speech signal decoding method according to any one of the first to eighth aspects of the invention.

According to a tenth aspect of the present invention, there is provided a speech signal decoding apparatus for decoding information concerning at least a sound source signal, gain and linear prediction coefficients from a received signal, generating an excitation signal and linear prediction coefficients from the decoded information, and driving a filter, which is constituted by the linear prediction coefficients, by the excitation signal to thereby decode a speech signal, comprising: a smoothing circuit smoothing the gain using a past value of the gain; and a smoothing-quantity limiting circuit limiting the value of the smoothed gain using an amount of fluctuation calculated from the gain and the smoothed gain.

According to an 11th aspect of the present invention, there is provided a speech signal decoding apparatus for decoding information concerning an excitation signal and linear prediction coefficients from a received signal, generating the excitation signal and linear prediction coefficients from the decoded information, and driving a filter, which is constituted by the linear prediction coefficients, by the excitation signal to thereby decode a speech signal, comprising: an excitation-signal normalizing circuit calculating a norm of the excitation signal at regular intervals and dividing the excitation signal by the norm; a smoothing circuit smoothing the norm using a past value of the norm; a smoothing-quantity limiting circuit limiting the value of the smoothed norm using an amount of fluctuation calculated from the norm and the smoothed norm; and an excitation-signal reconstruction circuit multiplying the smoothed and limited norm by the excitation signal to thereby change the amplitude of the excitation signal in the intervals.

According to a 12th aspect of the present invention, the foregoing object is attained by providing a speech signal decoding apparatus for decoding information concerning an excitation signal and linear prediction coefficients from a received signal, generating the excitation signal and linear prediction coefficients from the decoded information, and driving a filter, which is constituted by the linear prediction coefficients, by the excitation signal to thereby decode a speech signal, comprising a speech/noise identification circuit identifying a voiced segment and a noise segment with regard to the received signal using the decoded information; an excitation-signal normalizing circuit calculating (deriving) a norm of the excitation signal at regular intervals and dividing the excitation signal by the norm; a smoothing circuit for smoothing the norm using a past value of the norm; a smoothing-quantity limiting circuit limiting the value of the smoothed norm using an amount of fluctuation calculated from the norm and the smoothed norm; and an excitation-signal reconstruction circuit multiplying the smoothed and limited norm by the excitation signal to thereby change the amplitude of the excitation signal in the intervals.

According to a 13th aspect of the present invention, in the 10th aspect of the invention the amount of fluctuation is represented by dividing an absolute value of a difference between the gain and the smoothed gain by the gain, and the value of the smoothed gain is limited in such a manner that the amount of fluctuation will not exceed a certain threshold value.

According to a 14th aspect of the present invention, in the 11th and 12th aspects of the invention the amount of fluctuation is represented by dividing the absolute value of the difference between the norm and the smoothed norm by the norm, and the value of the smoothed norm is limited in such a manner that the amount of fluctuation will not exceed a certain threshold value.

According to a 15th aspect of the present invention, in the 10th or 13th aspect of the invention, the apparatus comprises a switching circuit in which switching between use of the gain and use of the smoothed gain is performed in accordance with an entered switching control signal when the speech signal is decoded.

According to a 16th aspect of the present invention, in the 11th, 12th or 14th aspect of the invention, the apparatus comprises a switching circuit in which switching between use of the excitation signal and use of the excitation signal the amplitude of which has been changed is performed in accordance with an entered switching control signal when the speech signal is decoded.

According to an 17th aspect of the present invention, there is provided a speech signal encoding and decoding apparatus comprising: a speech signal encoding apparatus encoding an input speech signal by expressing it by an excitation signal and linear prediction coefficients, and a speech signal decoding apparatus according to any one of the 10th to 16th aspects of the invention.

According to an 18th aspect of the present invention, there is provided a program product, or a medium on which has been recorded the program product, for implementing a speech signal decoding method for decoding information concerning at least a sound source signal, gain and linear prediction coefficients from a received signal, generating the excitation signal and the linear prediction coefficients from the decoded information, and driving a filter, which is constituted by the linear prediction coefficients, by the excitation signal to thereby decode a speech signal, wherein the program causes a computer to execute processing which includes smoothing the gain using a past value of the gain; limiting the value of the smoothed gain based upon an amount of fluctuation calculated from the gain and the smoothed gain; and decoding the speech signal using the gain that has been smoothed and limited.

According to an 19th aspect of the present invention, there is provided a program product for implementing a speech signal decoding method for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal. The program product causes a computer to execute processing which includes: (a) calculating a norm of an excitation signal at regular intervals and smoothing the norm using a past value of the norm; (b) limiting the value of the smoothed norm; based upon an amount of fluctuation calculated from the norm and the smoothed norm; and (c) changing the amplitude of the excitation signal in the intervals using the norm and the norm that has been smoothed and limited; and driving the filter by the excitation signal the amplitude of which has been changed.

According to an 20th aspect of the present invention, there is provided a program product for implementing a speech signal decoding method for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal. The program product causes a computer to execute processing which includes: (a) identifying a voiced segment and a noise segment with regard to a received signal using decoded information; (b) calculating a norm of an excitation signal at regular intervals in the noise segment and smoothing the norm using a past value of the norm; (c) limiting the value of the smoothed norm using an amount of fluctuation calculated from the norm and the smoothed norm; and (d) changing the amplitude of the excitation signal in the intervals using the norm and the norm that has been smoothed and limited; and driving the filter by the excitation signal the amplitude of which has been changed.

According to a 21st aspect of the present invention, in the 18th aspect of the invention there is provided a program product which includes representing the amount of fluctuation by dividing an absolute value of a difference between the gain and the smoothed gain by the gain, and limiting the value of the smoothed gain in such a manner that the amount of fluctuation will not exceed a certain threshold value.

According to a 22nd aspect of the present invention, in the 19th or 20th aspect of the invention there is provided a program product which includes representing the amount of fluctuation by dividing the absolute value of the difference between the norm and the smoothed norm by the norm, and limiting the value of the smoothed norm in such a manner that the amount of fluctuation will not exceed a certain threshold value.

According to a 23rd aspect of the present invention, in the 19th, 20th or 22nd aspect of the invention there is provided a program product which includes dividing the excitation signal in the intervals by the norm in the intervals and multiplying the quotient by the smoothed norm in the intervals to thereby change the amplitude of the excitation signal.

According to a 24th aspect of the present invention, in the 18th or 21st aspect of the invention there is provided a program product which includes switching between use of the gain and use the smoothed gain in accordance with an entered switching control signal when the speech signal is decoded.

According to a 25th aspect of the present invention, in the 19th, 20th, 22nd and 23rd aspect of the invention there is provided a program product which includes switching between use of the excitation signal and use of the excitation signal the amplitude of which has been changed in accordance with an entered switching control signal when the speech signal is decoded.

According to a 26th aspect of the present invention, there is provided a program product which includes encoding an input speech signal by expressing it by an excitation signal and linear prediction coefficients, and performing decoding by the speech signal decoding method according to any one of the first, to eighth aspects of the invention.

According to a further aspect the program product may be carried by a suitable medium which includes dynamic and/or static medium, such as a recording medium, and/or carrier wave etc.

Other aspects are disclosed in the claims 27 et seq, which are incorporated herein by reference thereto.

Other objects, features and advantages of the present invention will be apparent to those skilled in the art from the following description taken in conjunction with the accompanying drawings, in which like reference characters designate the same or similar parts throughout the figures thereof.

PREFERRED EMBODIMENTS OF THE INVENTION

Preferred modes of practicing the present invention will now be described.

In the present invention, a smoothing circuit (1320 in FIG. 1) smoothes sound source gain (second gain) in a noise segment using sound source gain obtained in the past, and a smoothing-quantity limiting circuit (7200 in FIG. 1) obtains the amount of fluctuation between the sound source gain (second gain) and the sound source gain smoothed by the smoothing circuit (1320 in FIG. 1) and limits the value of the smoothed gain in such a manner that the amount of fluctuation will not exceed a certain threshold value. Thus, the values that can be taken on by the smoothed sound source gain are limited based upon an amount of fluctuation calculated using a difference between the smoothed sound source gain and the sound source gain in such a manner that the sound source gain smoothed in the noise segment will not take on a value that is very large in comparison with the sound source gain before smoothing. As a result, the occurrence of abnormal sound in the noise segment is avoided.

Figure 1:
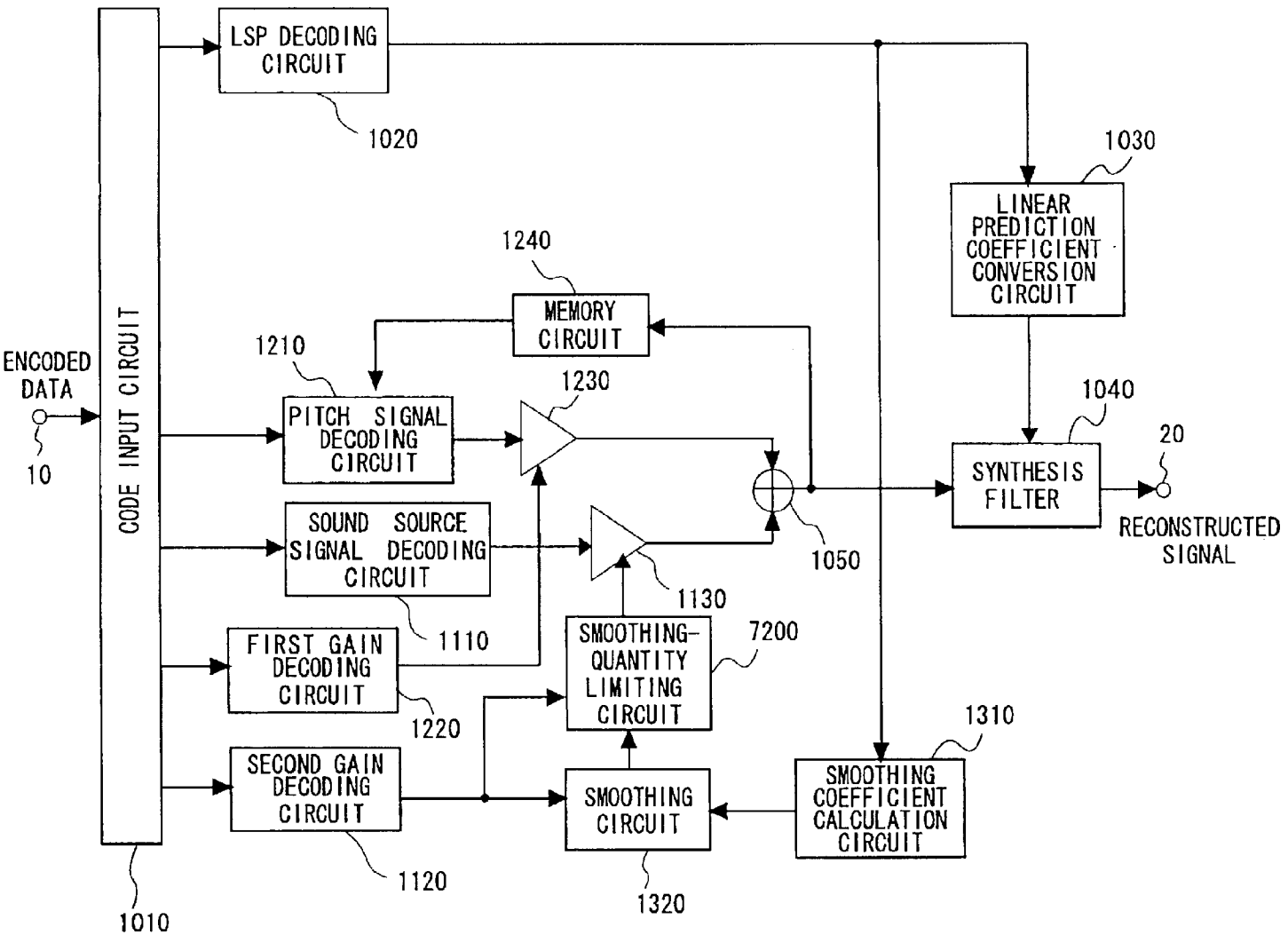
FIG. 1 is a block diagram illustrating the construction of a speech signal decoding apparatus according to a first embodiment of the present invention.

In a first preferred mode of the present invention, as shown in FIG. 1, a speech signal decoding apparatus is for decoding information concerning at least a sound source signal, gain and linear prediction (LP) coefficients from a received signal, generating an excitation signal and linear prediction coefficients from the decoded information, and driving a filter, which is constituted by the linear prediction coefficients, by the excitation signal to thereby decode a speech signal, and the apparatus includes a smoothing circuit (1320) for smoothing the gain using a past value of the gain, and smoothing-quantity limiting circuit (7200) for limiting the value of the smoothed gain using an amount of fluctuation calculated from the gain and the smoothed gain. The smoothing-quantity limiting circuit (7200) obtains the amount of fluctuation by dividing the absolute value of the difference between sound source gain (second gain) and the smoothed sound source gain by the sound source gain.

More specifically, the apparatus includes: a code input circuit (1010) for splitting code of the a bit sequence of an encoded input signal that enters from an input terminal, converting the code to indices that correspond to a plurality of decode parameters, outputting an index corresponding to a line spectrum pair (LSP), which represents frequency characteristic of the input signal, to an LSP decoding circuit, outputting an index corresponding to a delay that represents the pitch period of the input signal to a pitch signal decoding circuit, outputting an index corresponding to a sound source vector comprising a random number or a pulse train to a sound source signal decoding circuit, outputting an index corresponding to a first gain to a first gain decoding circuit, and outputting an index corresponding to a second gain to a second gain decoding circuit; the LSP decoding circuit (1020), to which the index output from the code input circuit (1010) is input, for reading the LSP corresponding to the input index out of a table which stores LSPs corresponding to indices, obtains an LSP in a subframe of the present frame (the nth frame), and outputs the LSP; the linear prediction coefficient conversion circuit (1030), to which the LSP output from the LSP decoding circuit is input, for converting the LSP to linear prediction coefficients and outputting the coefficients to a synthesis filter; the sound source signal decoding circuit (1110), to which the index output from the code input circuit (1010) is input, for reading a sound source vector corresponding to the index out of a table which stores sound source vectors corresponding to indices, and outputting the sound source vector to a second gain decoding circuit; the second gain decoding circuit (1120), to which the index output from the code input circuit (1010) is input, for reading a second gain corresponding to the input index out of a table which stores second gains corresponding to indices, and outputting the second gain to a smoothing circuit; the second gain circuit (1130), to which a first sound source vector output from the sound source signal decoding circuit (1110) and the second gain are input, for multiplying the first sound source vector by the second gain to generate a second sound source vector and outputting the generated second sound source vector to the adder (1050); the memory circuit (1240) for holding an excitation vector input thereto from the adder (1050) and outputting a held excitation vector, which was input thereto in the past, to the pitch signal decoding circuit (1210); the pitch signal decoding circuit (1210), to which the past excitation vector held by the memory circuit (1240) and the index (which specifies a delay $L_{pd}$) output from the code input circuit (1010) are input, for cutting vectors of samples corresponding to the vector length from a point $L_{pd}$ samples previous to the starting point of the present frame, generating a first pitch vector and outputting the first pitch vector to the first gain circuit (1230); the first gain decoding circuit (1220), to which the index output from the code input circuit (1010) is input, for reading a first gain corresponding to the input index out of a table and outputting the first gain to a first gain circuit; the first gain circuit (1230), to which the first pitch vector output from the pitch signal decoding circuit (1210) and the first gain output from the first gain decoding circuit (1220) are input, for multiplying the input first pitch vector by the first gain to generate a second pitch vector and outputting the generated second pitch vector to the adder; the adder (1050), to which the second pitch vector output from the first gain circuit (1230) and the second sound source vector output from the second gain circuit (1130) are input, for calculating the sum of these inputs and outputting the sum to the synthesis filter (1040) as an excitation vector; the smoothing coefficient calculation circuit (1310), to which LSP output from the LSP decoding circuit (1020) is input, for calculating average LSP in an nth frame, finding the amount of fluctuation of the LSP with respect to each subframe, finding a smoothing coefficient in the subframe and outputting the smoothing coefficient to a smoothing circuit; the smoothing circuit (1320), to which the smoothing coefficient output from the smoothing coefficient calculation circuit (1310) and the second gain output from the second gain decoding circuit are input, for finding the average gain from the second gain in the subframe and outputting the second gain; the synthesis filter (1040), to which the excitation vector output from the adder (1050) and the linear prediction coefficients output from the linear prediction coefficient conversion circuit (1030) are input, for driving a synthesis filter, for which the linear prediction coefficients have been set, by the excitation vector to thereby calculate a reconstructed vector, and outputting the reconstructed vector from an output terminal; and the smoothing-quantity limiting circuit (7200), to which the second gain output from the second gain decoding circuit (1120) and the smoothed second gain output from the smoothing circuit (1320) are input, for finding the amount of fluctuation between the smoothed second gain output from the smoothing circuit (1320) and the second gain output from the second gain decoding circuit (1120), using the smoothed second gain as is when the amount of fluctuation is less than a predetermined threshold value, replacing the smoothed second gain with a smoothed second gain limited in terms of the values it is capable of taking on when the amount of fluctuation is equal to or greater than the threshold value, and outputting this smoothed second gain to the second gain circuit (1130).

Figure 2:
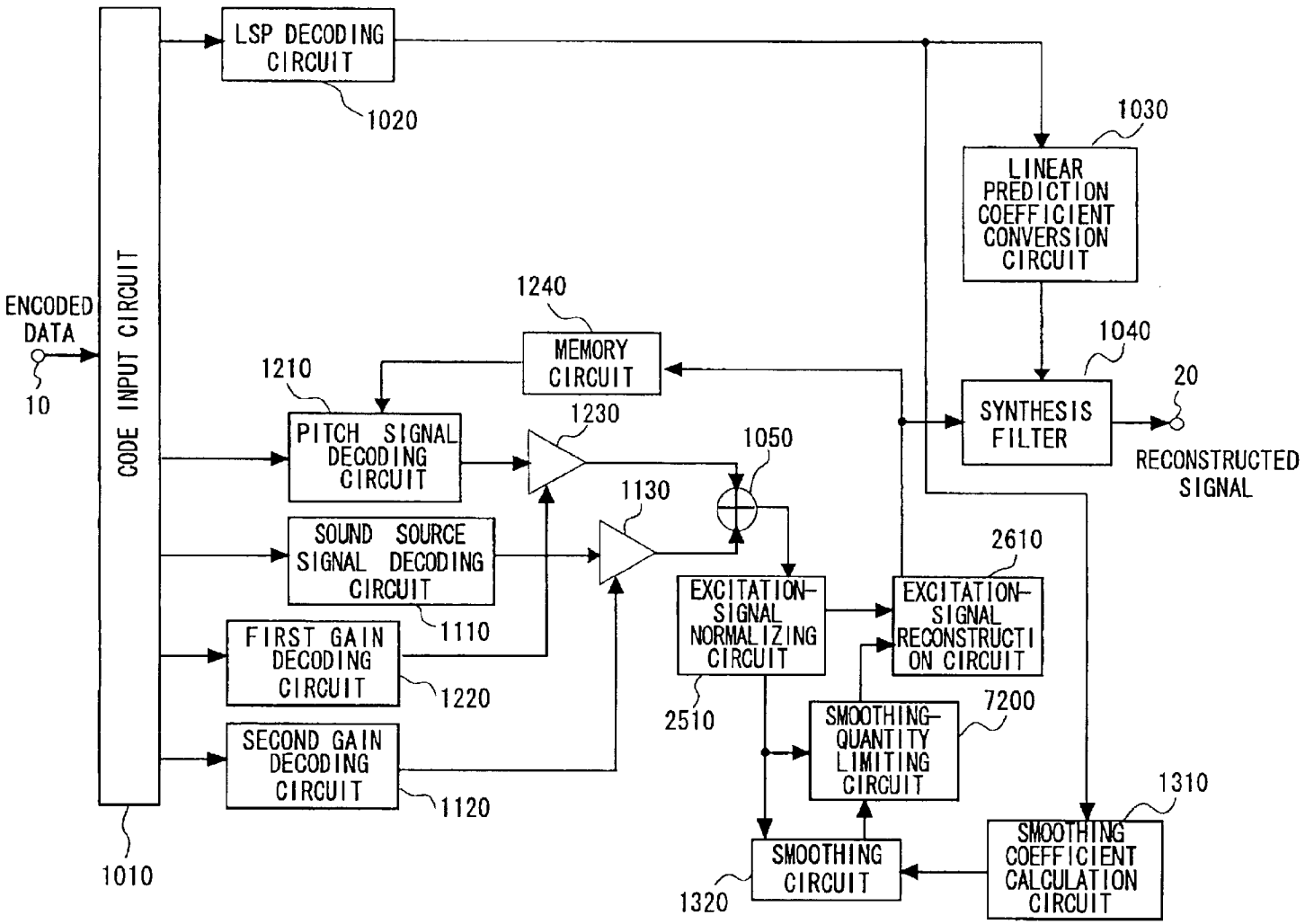
FIG. 2 is a block diagram illustrating the construction of a speech signal decoding apparatus according to a second embodiment of the present invention.

In a second preferred mode of the present invention, as shown in FIG. 2, a speech signal decoding apparatus is for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal. Particularly, the apparatus includes an excitation-signal normalizing circuit (2510) for deriving a norm of the excitation signal at regular intervals and dividing the excitation signal by the norm; a smoothing circuit (1320) for smoothing the norm using a past value of the norm; a smoothing-quantity limiting circuit (7200) for limiting the value of the smoothed norm using an amount of fluctuation calculated from the norm and the smoothed norm; and an excitation-signal reconstruction circuit (2610) for multiplying the smoothed and limited norm by the excitation signal to thereby change the amplitude of the excitation signal in the intervals.

More specifically, the apparatus includes: an excitation-signal normalizing circuit (2510), to which an excitation vector in a subframe output from the adder (1050) is input, for calculating gain and a shape vector from the excitation vector every subframe or every sub-subframe obtained by subdividing a subframe, outputting the gain to the smoothing circuit (1320) and outputting the shape vector to an excitation-signal reconstruction circuit (2610); and the excitation-signal reconstruction circuit (2610), to which the gain output from the smoothing-quantity limiting circuit (7200) and the shape vector output from the excitation-signal normalizing circuit (2510) are input, for calculating a smoothed excitation vector and outputting this excitation vector to the memory circuit (1240) and synthesis filter (1040). In this apparatus, the smoothing-quantity limiting circuit (7200) has the output of the smoothing circuit (1320) applied to one input terminal thereof and has the output of the excitation-signal normalizing circuit (2510), rather than the output of the second gain decoding circuit (1120) as in the first mode, applied to the other input terminal thereof, finds the amount of fluctuation between the smoothed gain output from the smoothing circuit (1320) and the gain output from the excitation-signal normalizing circuit (2510), uses the smoothed gain as is when the amount of fluctuation is less than a predetermined threshold value, replaces the smoothed gain with a smoothed gain limited in terms of values it is capable of taking on when the amount of fluctuation is equal to or greater than the threshold value, and supplies this smoothed gain to the excitation-signal reconstruction circuit (2610); the output of the second gain decoding circuit (1120) is input to the second gain circuit (1130) as second gain; and the smoothing circuit (1320) has the output of the excitation-signal normalizing circuit (2510), rather than the output of the second gain decoding circuit (1120) as in the first mode, applied thereto, as well as the output of the smoothing coefficient calculation circuit (1310).

Figure 3:
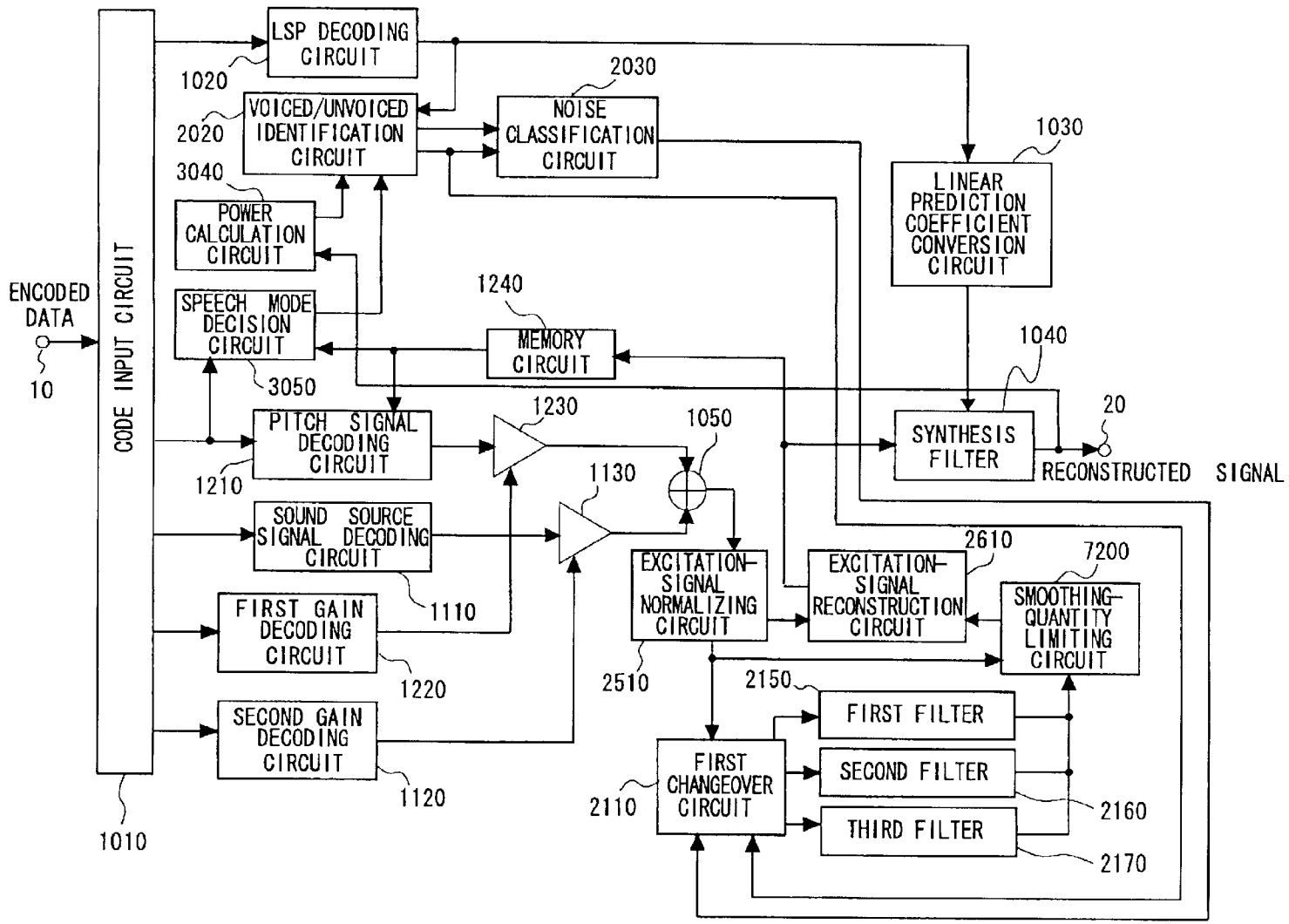
FIG. 3 is a block diagram illustrating the construction of a speech signal decoding apparatus according to a third embodiment of the present invention.

In a third preferred mode of the present invention, as shown in FIG. 3, a speech signal decoding apparatus is for decoding information concerning an excitation signal and linear prediction coefficients from a received signal, generating excitation signal and linear prediction coefficients from the decoded information, and driving a filter, which is constituted by the linear prediction coefficients, by the excitation signal to thereby decode a speech signal, and the apparatus includes: a voiced/unvoiced identification circuit (2020) for identifying a speech segment and a noise segment with regard to the received signal using the decoded information; the excitation signal normalizing circuit (2510) for calculating a norm of the excitation signal at regular intervals and dividing the excitation signal by the norm; the smoothing circuit (1320) for smoothing the norm using a past value of the norm; the smoothing-Quantity limiting circuit (7200) for limiting the value of the smoothed norm using an amount of fluctuation calculated from the norm and the smoothed norm; and excitation-signal reconstruction circuit (2610) for multiplying the smoothed and limited norm by the excitation signal to thereby change the amplitude of the excitation signal in the intervals. The voice/unvoiced identification circuit 2020 detects speech and noise segments but is referred to as voice/unvoiced identification circuit. Moreover, the Specification may refer to speech segment as a voice segment and noise segment as a "unvoiced" segment.

More specifically, the apparatus includes: a power calculation circuit (3040), to which the reconstructed vector output from the synthesis filter (1040) is input, for calculating the sum of the squares of the reconstructed vector and outputting the power to a voiced/unvoiced identification circuit; a speech mode decision circuit (3050), to which a past excitation vector held by the memory circuit (1240) and an index specifying a delay output from the code input circuit (1010) are input, for calculating a pitch prediction gain in a subframe from the past excitation vector and delay, determining a predetermined threshold value with respect to the pitch prediction gain or with respect to an in-frame average value of the pitch prediction gain in a certain frame, and setting a speech mode; the voiced/unvoiced identification circuit (2020), to which an LSP output from the LSP decoding circuit (1020), the speech mode output from the speech mode decision circuit (3050) and the power output from the power calculation circuit (3040) are input, for finding the amount of fluctuation of a spectrum parameter and identifying a voice segment and an unvoiced segment based upon the amount of fluctuation; a noise classification circuit (2030), to which amount-of-fluctuation information) and an identification flag output from the voiced/unvoiced identification circuit (2020) are input, for classifying noise; and a first changeover circuit (2110), to which the gain output from an excitation-signal normalizing circuit (2510), an identification flag output from the voiced/unvoiced identification circuit (2020) and a classification flag output from the noise classification circuit (2030) are input, for changing over a switch in accordance with a value of the identification flag and a value of the classification flag to thereby switchingly output the gain to any one of a plurality of filters (2150, 2160, 2170) having different filter characteristics from one another; wherein the filter selected from among the plurality of filters (2150, 2160, 2170) has the gain output from the first changeover circuit (2110) applied thereto, smoothes the gain using a linear filter or non-linear filter and outputs the smoothed gain to the smoothing-quantity limiting circuit (7200) as a first smoothed gain; and the smoothing-quantity limiting circuit (7200) has the first smoothed gain output from the selected filter applied to one input terminal thereof, has the output of the excitation-signal normalizing circuit (2510) applied to the other input terminal thereof, finds the amount of fluctuation between the gain output from the excitation-signal normalizing circuit (2510) and the first smoothed gain output from the selected filter, uses the first smoothed gain as is when the amount of fluctuation is less than a predetermined threshold value, replaces the first smoothed gain with a smoothed gain limited in terms of values it is capable of taking on when the amount of fluctuation is equal to or greater than the threshold value, and supplies this smoothed gain to the excitation-signal reconstruction circuit (2610).

Figure 4:
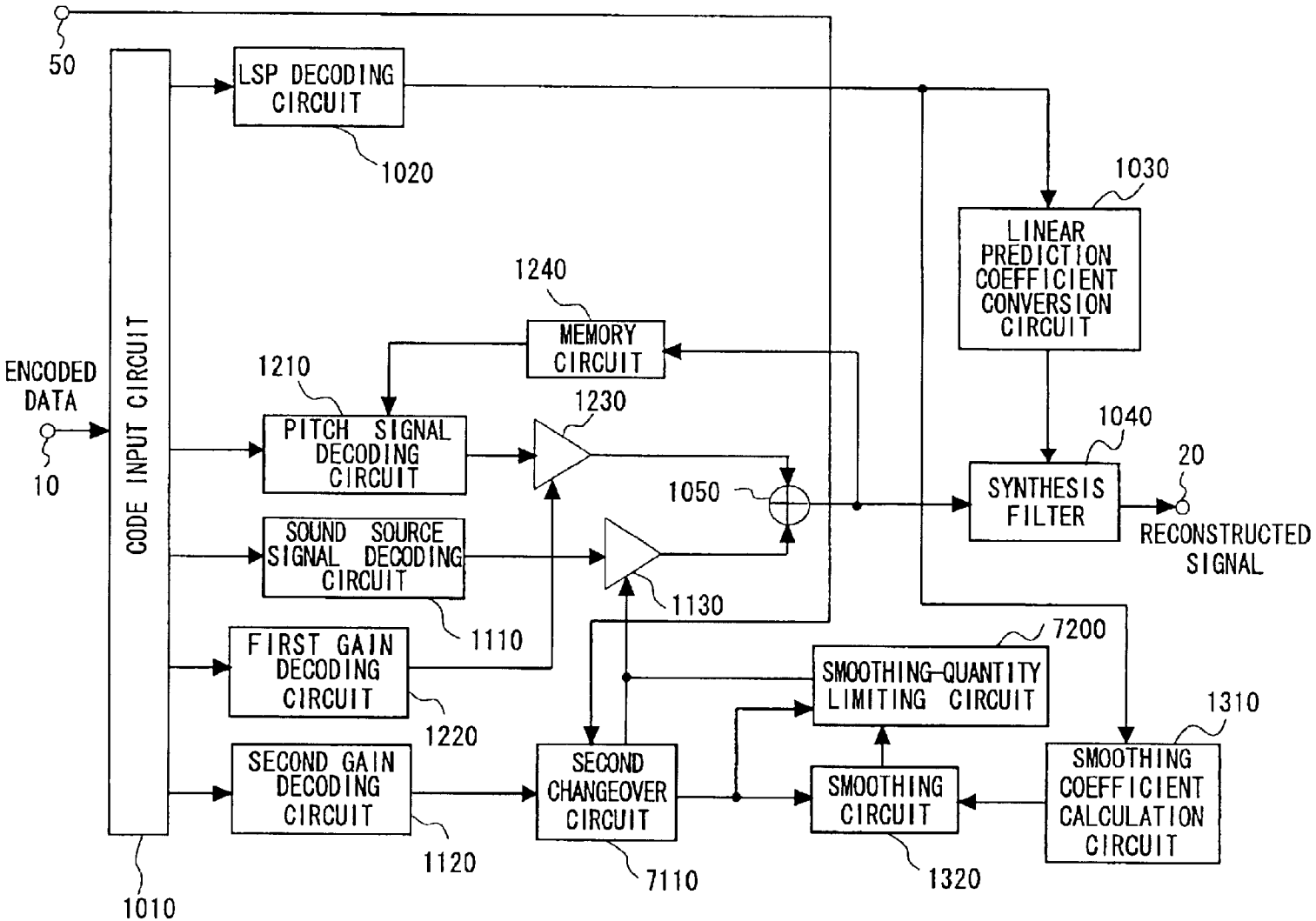
FIG. 4 is a block diagram illustrating the construction of a speech signal decoding apparatus according to a fourth embodiment of the present invention.

In a preferred mode of the present invention, as shown in FIG. 4, switching between use of the gain and use of the smoothed gain may be performed by a changeover circuit (7110) in accordance with an entered switching control signal when the speech signal is decoded.

Figure 5:
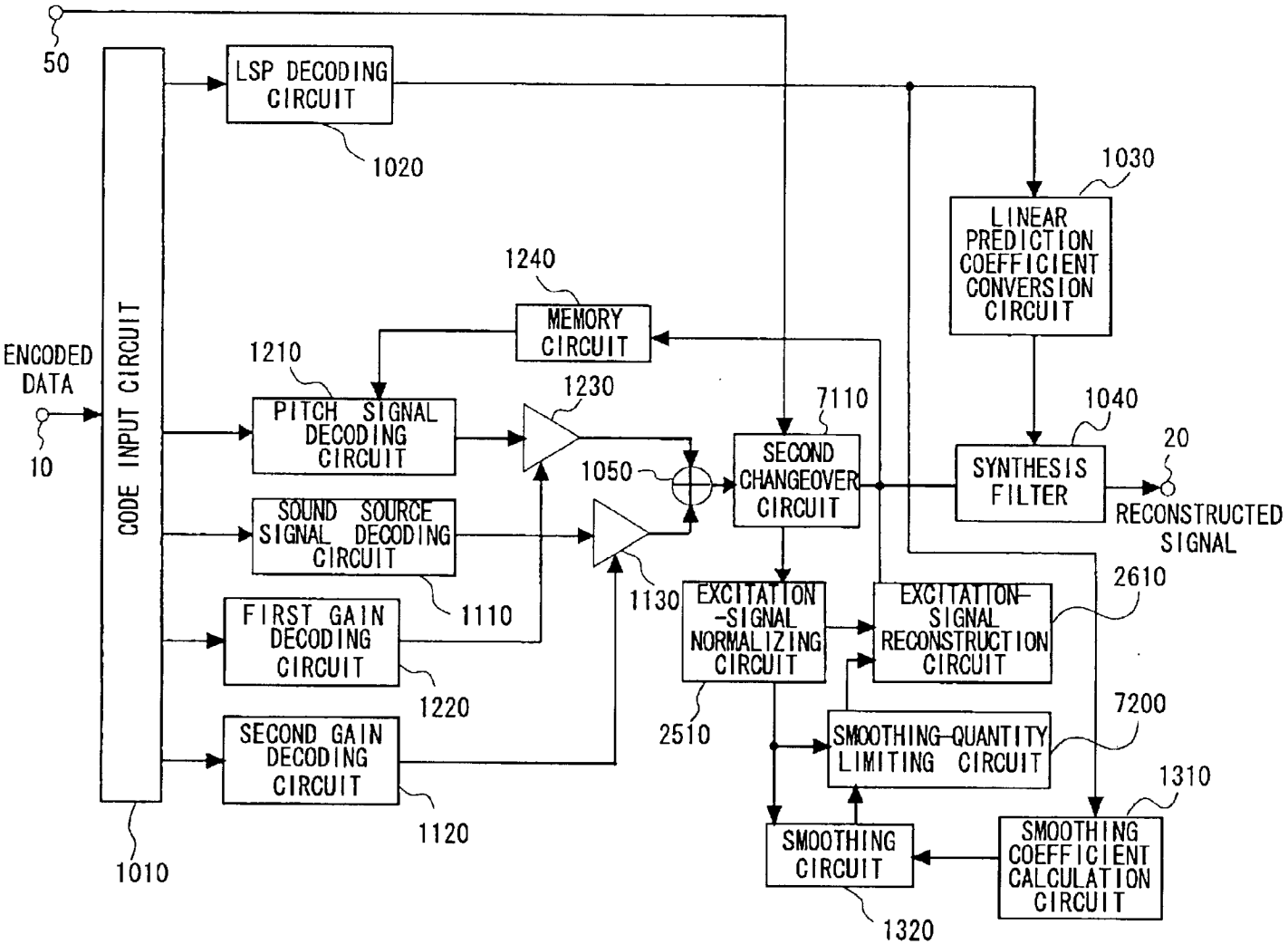
FIG. 5 is a block diagram illustrating the construction of a speech signal decoding apparatus according to a fifth embodiment of the present invention.
Figure 6:
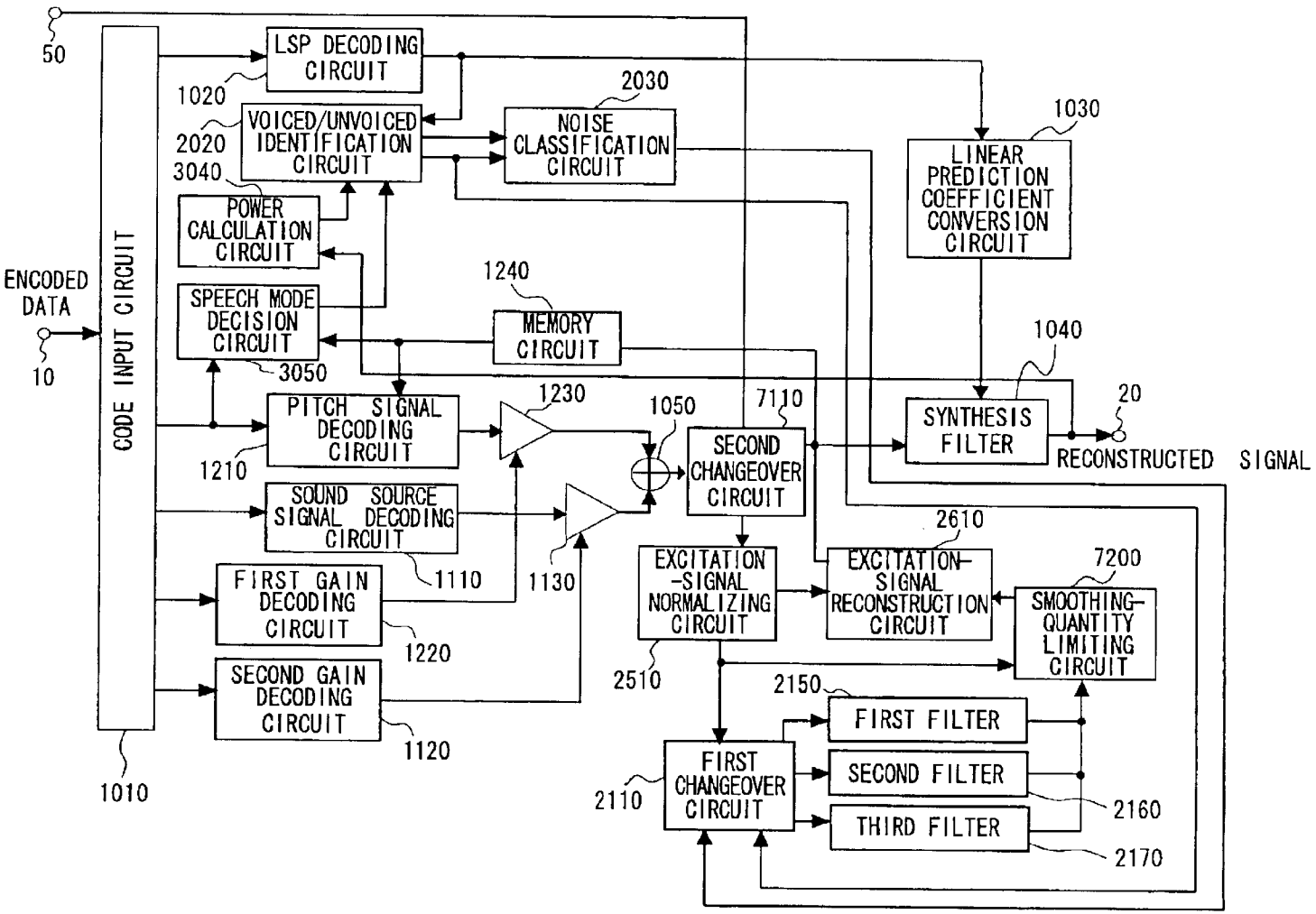
FIG. 6 is a block diagram illustrating the construction of a speech signal decoding apparatus according to a sixth embodiment of the present invention.

In a preferred mode of the present invention, as shown in FIG. 5 or 6, the apparatus further includes a second changeover circuit (7110), to which the excitation vector output from the adder (1050) is input, for outputting the excitation vector to the synthesis filter (1040) or to the excitation-signal normalizing circuit (2510) in accordance with a changeover control signal, which has entered from an input terminal (50), when the speech signal is decoded.

Embodiments of the present invention will now be described with reference to the drawings in order to explain further the modes of the invention set forth above.

FIG. 1 is a block diagram illustrating the construction of a speech signal decoding apparatus according to a first embodiment of the present invention. Components in FIG. 1 identical with or equivalent to those shown in FIG. 8 are identified by like reference characters.

Figure 8:
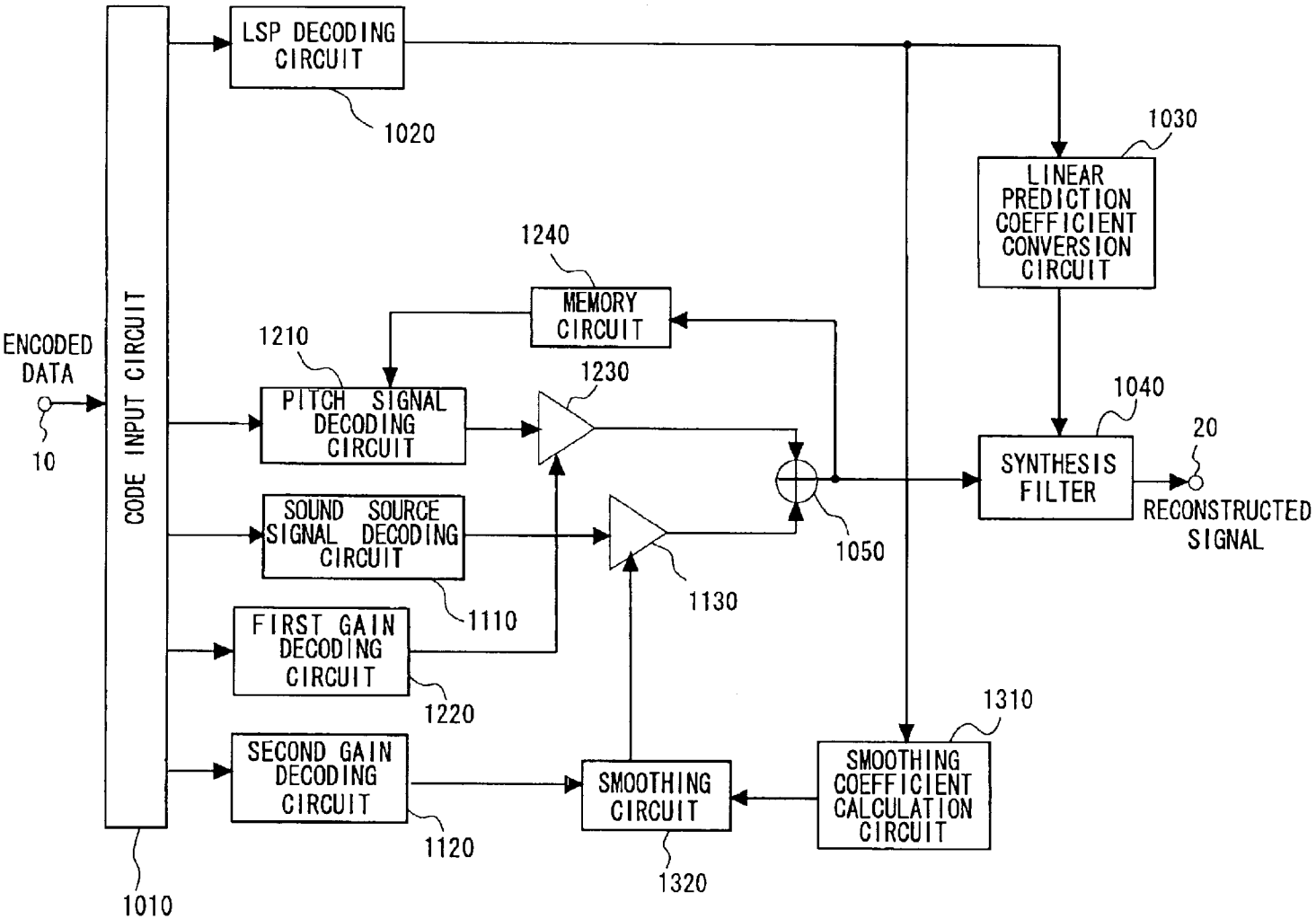
FIG. 8 PRIOR ART
FIG. 8 is a block diagram illustrating the construction of a speech signal decoding apparatus according to the prior art.
Figure 9:
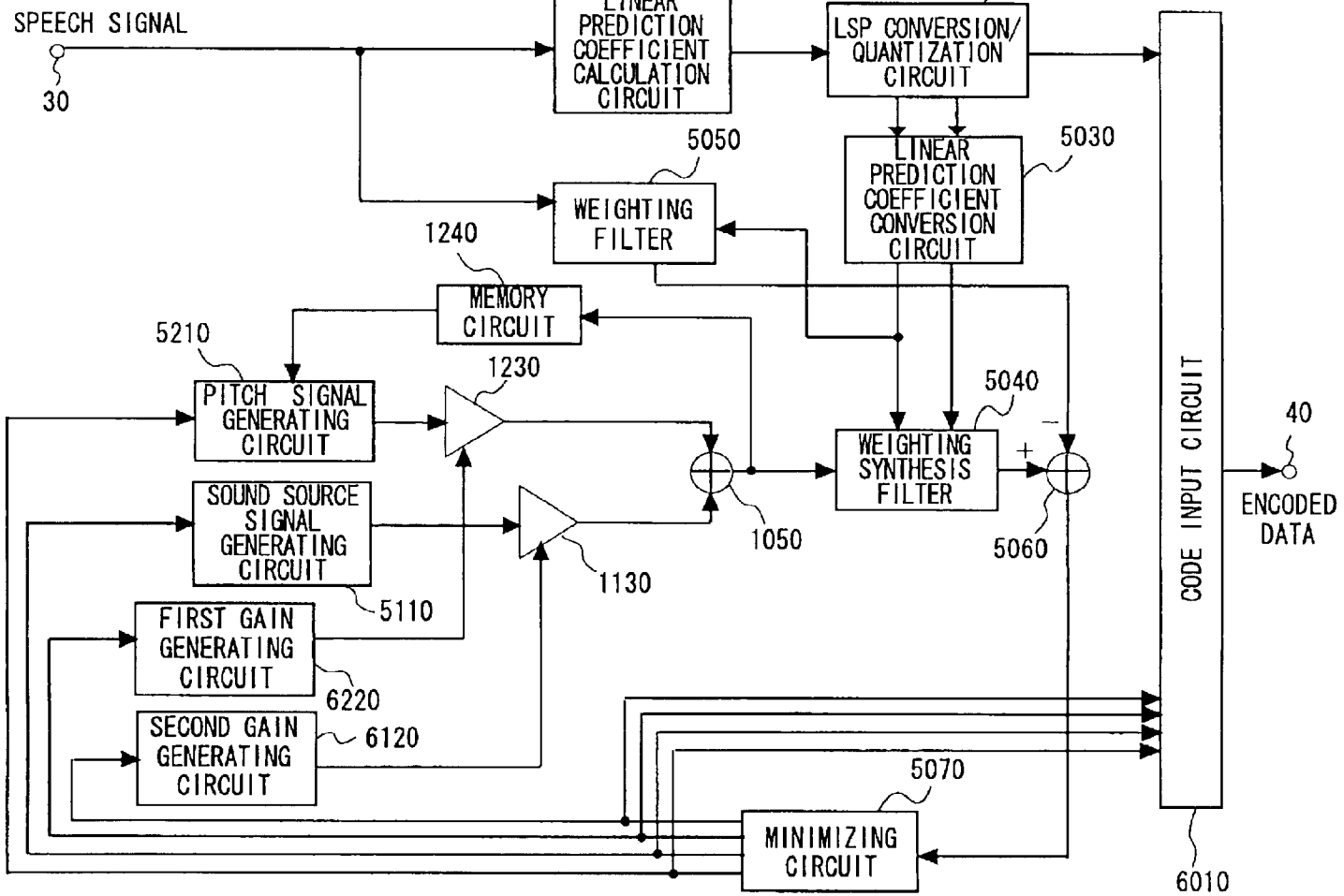
FIG. 9 PRIOR ART
FIG. 9 is a block diagram illustrating the construction of a speech signal encoding apparatus according to the prior art.

In FIG. 1, the input terminal 10, output terminal 20, code input circuit 1010, LSP decoding circuit 1020, linear prediction coefficient conversion circuit 1030, sound source signal decoding circuit 1110, memory circuit 1240, pitch signal decoding circuit 1210, first gain decoding circuit 1220, second gain decoding circuit 1120, first gain circuit 1230, second gain circuit 1130, adder 1050, smoothing coefficient calculation circuit 1310, smoothing circuit 1320 and synthesis filter 1040 are identical with the similarly identified components shown in FIG. 8 and need not be described again. The entire description made in the introductory part of this application with respect to FIG. 8 is hereby incorporated as part of the disclosure of the present invention, as far as it relates to the present invention, too. Primarily, only components that differ from those shown in FIG. 8 will be described below.

In the first embodiment of the present invention illustrated in FIG. 1, the smoothing-quantity limiting circuit 7200 has been added onto the arrangement of FIG. 8. As in the arrangement of FIG. 8, in the first embodiment of the invention it is assumed that the input of the bit sequence occurs in $T_{fr}$ msec (e. g., 20 ms) and that computation of the reconstructed vector is performed in a period (subframe) of $T_{fr}/N_{sfr}$ msec (e. g., 5 ms), where $N_{sfr}$ is an integer (e. g., 4). Let frame length be $L_{fr}$ samples (e. g., 320 samples) and let subframe length be $L_{sfr}$ samples (e. g., 80 samples). The numbers of these samples is decided by the sampling frequency (e. g., 16 kHz) of the input signal.

The second gain (represented by $g_2$) output from the second gain decoding circuit 1120 and the smoothed second gain (represented by $\bar{g}_2$) output from the smoothing circuit 1320 are input to the smoothing-quantity limiting circuit 7200.

The second gain $\bar{g}_2$ output from the smoothing circuit 1320 is limited in terms of the values it can take on in such a manner that it will not become abnormally large or abnormally small in comparison with the second gain $g_2$ output from the second gain decoding circuit 1120.

First, let amount $d_{g2}$ of fluctuation of $\bar{g}_2$ be represented by $$d_{g2}=|\bar{g}_2-g_2|/g_2 \tag{11}$$

When the fluctuation amount $d_{g2}$ is less than a certain threshold value $C_{g2}$, is used as is. When the fluctuation amount $d_{g2}$ is equal to or greater than the threshold value $C_{g2}$, is limited. That is, $\bar{g}_2$ is replaced using the following criterion:

$$\text{if } (d_{g2}<C_{g2}) \text{ then } \bar{g}_2=\bar{g}_2$$

else if $(\bar{g}_2-g_2>0)$ then $\bar{g}_2=(1+C_{g2})\cdot g_2$ else $\bar{g}_2=(1-C_{g2})\cdot g_2$ In other words, if $d_{g2}<C_{g2}$ is true, then $\bar{g}_2$ is used as is;

if $d_{g2}<C_{g2}$ is false (i.e., if $d_{g2}\geqq C_{g2}$ holds), then a substitution is made for as follows:

$\bar{g}_2=(1+C_{g2})\cdot g_2$ when $\bar{g}_2-g_2>0$ holds true; and $\bar{g}_2=(1-C_{g2})\cdot g_2$ when $\bar{g}_2-g_2\leqq 0$ holds true.

Here it is assumed that $C_{g2}=0.90$ holds.

Finally, the smoothing-quantity limiting circuit 7200 outputs the substitute $\bar{g}_2$ to the second gain circuit 1130.

A second embodiment of the present invention will now be described.

FIG. 2 is a block diagram illustrating the construction of a speech signal decoding apparatus according to a second embodiment of the present invention. Components in FIG. 2 identical with or equivalent to those shown in FIGS. 1 and 8 are identified by like reference characters.

As shown in FIG. 2, the second embodiment is so adapted that the norm of the excitation vector is smoothed instead of the decoded sound source gain (the second gain) as in the first embodiment. It should be noted that the input terminal 10, output terminal 20, code input circuit 1010, LSP decoding circuit 1020, linear prediction coefficient conversion circuit 1030, sound source signal decoding circuit 1110, memory circuit 1240, pitch signal decoding circuit 1210, first gain decoding circuit 1220, second gain decoding circuit 1120, first gain circuit 1230, second gain circuit 1130, adder 1050, smoothing coefficient calculation circuit 1310, smoothing circuit 1320 and synthesis filter 1040 are identical with the similarly identified components shown in FIG. 8 and need not be described again.

As shown in FIG. 2, the second embodiment of the invention additionally provides the arrangement of the first embodiment illustrated in FIG. 1 with the excitation-signal normalizing circuit 2510, the input to which is the output of the adder 1050, and with the excitation-signal reconstruction circuit 2610, the inputs to which are the outputs of the excitation-signal normalizing circuit 2510 and smoothing-quantity limiting circuit 7200 and the output of which is delivered to synthesis filter 1040 and memory circuit 1240.

The output of the smoothing circuit 1320 and the output of the excitation-signal normalizing circuit 2510 are input to the smoothing-quantity limiting circuit 7200, which supplies its output to the excitation-signal reconstruction circuit 2610. In other aspects this embodiment is similar to the first embodiment except for the signal connections.

The excitation-signal normalizing circuit 2510 and excitation-signal reconstruction circuit 2610 will now be described.

An excitation vector $X_{exc}^{(m)}(i)$ (where i=0, . . . , $L_{sfr}-1$, m=0, . . . , $N_{sfr}-1$) in an mth subsample output from the adder 1050 is input to the excitation-signal normalizing circuit 2510. The latter calculates gain and a shape vector from the excitation vector $X_{exc}^{(m)}(i)$ every subframe or every sub-subframe obtained by subdividing a subframe, outputs the gain to the smoothing circuit 1320 and outputs the shape vector to the excitation-signal reconstruction circuit 2610. A norm represented by Equation (12) below is used as the gain.

$$g_{exc}(m\cdot N_{ssfr}+1)=\sqrt{\sum_{n=0}^{L_{sfr}/N_{ssfr}-1} x_{exc}^{(m)}\left(1\cdot\frac{L_{sfr}}{N_{ssfr}}+n\right)^2}, \tag{12}$$

$$m=0,\ldots,N_{sfr}-,1=0,\ldots,N_{ssfr}-1$$

where $N_{ssfr}$ represents the number of subdivisions (the number of sub-subframes) of a subframe (e.g., $N_{ssfr}=2$). The excitation-signal normalizing circuit 2510 calculates the shape vector, which is obtained by dividing the excitation vector $X_{exc}^{(m)}(i)$ by gain $g_{exc}(j)$ (where j=0, . . . $N_{ssfr}\cdot N_{sfr}-1$), in accordance with Equation (13) below.

$$1^{s_{exc}^{(m\cdot N_{ssfr}+1)}}(i)=\frac{1}{g_{exc}(m\cdot N_{ssfr}+1)}\cdot x_{exc}^{(m)}\left(1\cdot\frac{L_{sfr}}{N_{ssfr}}+i\right), \tag{13}$$

$$i=0,\ldots,L_{ssfr}/N_{ssfr}-1,1=0,\ldots,N_{ssfr}-1,$$

$$m=0,\ldots,N_{sfr}-1$$

The gain $g_{exc}(j)$ (where j=0, . . . $N_{ssfr}\cdot N_{sfr}-1$) output from the smoothing circuit and a shape vector $s_{exc}^{(j)}(i)$ output from the excitation-signal normalizing circuit 2510 are input to the excitation-signal reconstruction circuit 2610. The latter calculates a (smoothed) excitation vector $\hat{X}_{exc}^{(m)}(i)$ in accordance with Equation (14) below and outputs the excitation vector to the memory circuit 1240 and synthesis filter 1040.

$$1^{\hat{x}_{exc}^{(m)}}\left(1\cdot\frac{L_{sfr}}{N_{ssfr}}+i\right)=g_{exc}(m\cdot N_{ssfr}+1)\cdot s_{exc}^{(m\cdot N_{ssfr}+1)}(i), \tag{14}$$

$$i=0,\ldots,L_{sfr}/N_{ssfr}-1,1=0,\ldots,N_{ssfr}-1,$$

$$m=0,\ldots,N_{ssfr}-1$$

A third embodiment of the present invention will now be described.

FIG. 3 is a block diagram illustrating the construction of a speech signal decoding apparatus according to a second embodiment of the present invention. Components in FIG. 3 identical with or equivalent to those shown in FIGS. 2 and 8 are identified by like reference characters. The input terminal 10, output terminal 20, code input circuit 1010, LSP decoding circuit 1020, linear prediction coefficient conversion circuit 1030, sound source signal decoding circuit 1110, memory circuit 1240, pitch signal decoding circuit 1210, first gain decoding circuit 1220, second gain decoding circuit 1120, first gain circuit 1230, second gain circuit 1130, adder 1050, smoothing coefficient calculation circuit 1310, smoothing circuit 1320 and synthesis filter 1040 are identical with the similarly identified components shown in FIG. 8, and the excitation-signal normalizing circuit 2510 and excitation-signal reconstruction circuit 2610 are identical with those shown in FIG. 2. Accordingly, these components need not be described again. Further, the smoothing-quantity limiting circuit 7200 is similar to that of the first embodiment except for a difference in the connections.

As shown in FIG. 3, the third embodiment of the invention additionally provides the arrangement of the second embodiment illustrated in FIG. 2 with the power calculation circuit 3040, speech mode decision circuit 3050, voiced/unvoiced identification circuit 2020, noise classification circuit 2030, first changeover circuit 2110, a first filter 2150, a second filter 2160 and a third filter 2170. How this embodiment differs from the second embodiment will now be described.

The reconstructed vector output from the synthesis filter 1040 is input to the power calculation circuit 3040. The latter calculates the sum of the squares of the reconstructed vector and outputs the power to a voiced/unvoiced identification circuit 2020. Here the power calculation circuit 3040 calculates power every subframe and uses the reconstructed vector output from the synthesis filter 1040 in an (m−1)th subframe in the calculation of power in an mth subframe. Letting the reconstructed vector be represented $S_{syn}(i)$, $i=0, \ldots, L_{sfr}$, power $E_{pow}$ is calculated in accordance with Equation (15) below.

$$E_{pow} = \frac{1}{L_{sfr}} \sum_{i=0}^{L_{sfr}-1} s_{syn}^2(i) \tag{15}$$

It is also possible to use the norm of the reconstructed vector represented by Equation (16) below instead of Equation (15).

$$E_{pow} = \sqrt{\sum_{i=0}^{L_{sfr}-1} s_{syn}^2(i)} \tag{16}$$

A past excitation vector $e_{mem}(i)$, $i=0, \ldots, L_{mem}-1$ held by the memory circuit (1240) and the index output from the code input circuit 1010 are input to the speech mode decision circuit 3050. The index specifies a delay $L_{pd}$. Here $L_{mem}$ represents a constant decided by the maximum value of $L_{pd}$. The speech mode decision circuit 3050 calculates a pitch prediction gain $G_{emem}(m)$, $m=0, 1, \ldots, N_{sfr}$ in the mth subframe from a past excitation vector $e_{mem}(i)$ and the delay $L_{pd}$.

$$G_{emem}(m)=10\cdot\log_{10}(g_{emem}(m)) \tag{17}$$

where $$g_{emem}(m) = \frac{1}{1 - \frac{E_c^2(m)}{E_{a1}(m)E_{a2}(m)}} \tag{18}$$

$$E_{a1}(m) = \sum_{i=0}^{L_{sfr}-1} e_{men}^2(i)$$

$$E_{a2}(m) = \sum_{i=0}^{L_{sfr}-1} e_{men}^2(i - L_{pd})$$

$$E_c(m) = \sum_{i=0}^{L_{sfr}-1} e_{mem}(i)e_{mem}(i - L_{pd})$$

The speech mode decision circuit 3050 executes the following threshold-value processing with respect to the pitch prediction gain $G_{emem}(m)$ or with respect to an in-frame average value of the pitch prediction gain $G_{emem}(m)$ in the nth frame, thereby setting a speech mode $S_{mode}$:

if $(\overline{G}_{emem}(n) \geqq 3.5)$ then $S_{mode}=2$ else $S_{mode}=0$

That is, if $\overline{G}_{emem}(n) \geqq 3.5$ holds, then the $S_{mode}$ is 2; otherwise, the $S_{mode}$ is 0.

The speech mode decision circuit 3050 outputs the speech mode $S_{mode}$ to the voiced/unvoiced identification circuit 2020.

$LSPq\hat{}_j^{(m)}(n)$ output from the LSP decoding circuit 1020, the speech mode $S_{mode}$ output from the speech mode decision circuit 3050 and the power $E_{pow}$ output from the power calculation circuit 3040 are input to the voiced/unvoiced identification circuit 2020. A procedure for obtaining the amount of fluctuation of a spectrum parameter is indicated below. Here $LSPq\hat{}_j^{(m)}(n)$ is used as the spectrum parameter. The voiced/unvoiced identification circuit 2020 calculates a long-term average $\overline{q}_j^{(m)}(n)$ in a (n) frame in accordance with Equation (19) below.

$$\overline{q}_j(n)=\beta_0\cdot\overline{q}_j(n-1)+(1-\beta_0)\cdot\hat{q}_j^{(N_{sh})}(n),\ j=1, \ldots, N_p \tag{19}$$

where $\beta_0=0.9$ Amount $d_q(n)$ of deviation (fluctuation) of LSP in the nth frame is defined by Equation (20) below.

$$d_q(n) = \sum_{j=1}^{N_q} \sum_{m=1}^{N_{sfr}} \frac{D_{qj}^{(m)}(n)}{\overline{q}_j(n)} \tag{20}$$

where $D^{(m)}_{qj}(n)$ corresponds to the distance between $\overline{q}_j(n)$ and $\hat{q}^{(m)}_j(n)$. For example, Equations (21a) and (21b) below are used.

$$D_{qj}^{(m)}(n)=(\overline{q}_j(n)-\hat{q}_j^{(m)}(n))^2 \tag{21a}$$

$$D_{qj}^{(m)}(n)=|\overline{q}_j(n)-\hat{q}_j^{(m)}(n)| \tag{21b}$$

In this embodiment, the absolute value of Equation (21b) is used as the distance.

Approximate correspondence can be established between an interval where the fluctuation $d_q(n)$ is large and a voiced segment and between an interval where the fluctuation $d_q(n)$ is small and an unvoiced (noise) segment.

However, the amount of fluctuation $d_q(n)$ varies greatly with time and the range of values of $d_q(n)$ in a voiced segment and the range of values of $d_q(n)$ in an unvoiced segment overlap each other. A problem which arises is that it is not easy to set a threshold value for distinguishing between voiced and unvoiced segments. Accordingly, the long-term average of $d_q(n)$ is used in the identification of the voiced and unvoiced segments.

The long-term average of $\overline{d}_{q1}(n)$ is found using a linear or non-linear filter. By way of example, the mean, median or mode of $d_q(n)$ can be employed as $\overline{d}_{q1}(n)$. Here Equation (22) is used.

$$\overline{d}_{q1}(n)=\beta\cdot\overline{d}_{q1}(n-1)+(1-\beta_1)\cdot d_q(n) \tag{22}$$

where $\beta_1=0.9$ holds.

An identification flag $S_{vs}$ is decided by applying threshold-value processing to $(\overline{d}_{q1}(n) \geqq C_{th1})$ then $S_{vs}=1$ else $S_{vs}=0$ That is, if $\overline{d}_{q1}(n) \geqq C_{th1}$ holds, $S_{vs}$ is 1; otherwise, $S_{vs}=0$ holds.

Here $C_{th1}$ represents a certain constant (e.g., 2.2), and $S_{vs}=1$ corresponds to a voiced segment and $S_{vs}=0$ to an unvoiced segment.

Since $d_q(n)$ is small in an interval where there is a high degree of steadiness, even in a voiced segment, the voiced segment may be mistaken for an unvoiced segment. Accordingly, in a case where the power of a frame is high and the pitch prediction gain is high, the segment is regarded as being a voiced segment. When $S_{vs}$=0holds, $S_{vs}$ is revised in accordance with the following criterion:

if ($\hat{E}_{rms} \geqq C_{rms}$ and $S_{mode} \geqq 2$) then $S_{vs}=1$ else $S_{vs}=0$ That is, if $\hat{E}_{rms} \geqq C_{rms}$ and $S_{mode} \geqq 2$ hold, $S_{vs}$ is 1; otherwise, $S_{vs}$ is 0.

Here $C_{rms}$ (where rms stands for the root-mean-square value) represents a certain constant (e.g., 10,000). The relation $S_{mode} \geqq 2$ corresponds to a case where the in-frame average value of pitch prediction gain is equal to or greater than 3.5 dB. The voiced/unvoiced identification circuit 2020 outputs $S_{vs}$ to the noise classification circuit 2030 and first changeover circuit 2110 and outputs to the noise classification circuit 2030.

The inputs to the noise classification circuit 2030 are $\bar{d}_{q1}(n)$ and $S_{vs}$ output from the voiced/unvoiced identification circuit 2020. The noise classification circuit 2030 obtains a value, which reflects the average behavior of $\bar{d}_{q1}(n)$, in an unvoiced segment (noise segment) by using a linear or non-linear filter. The noise classification circuit 2030 calculates $\bar{d}_{q2}(n)$ in accordance with Equation (23) below when $S_{vs}=0$ holds:

$$\bar{d}_{q2}(n)=\beta\cdot\bar{d}_{q2}(n-1)+(1-\beta_2)\cdot d_{q1}(n) \tag{23}$$

where $\beta_2=0.94$ holds. The noise classification circuit 2030 classifies noise by applying threshold-value processing to $\bar{d}_{q2}(n)$ and decides a classification flag $S_{nx}$.

if ($\bar{d}_{q2}(n) \geqq C_{th2}$ and $S_{mode} \geqq 2$) then $S_{nx}=1$ else $S_{nx}=0$ That is, $\bar{d}_{q2}(n) \geqq C_{th2}$ then $S_{mode} \geqq 2$ hold, the classification flag $S_{nx}$ is 1, otherwise, the classification flag $S_{nx}$ is 0.

Here $C_{th2}$ represents a certain constant (1.7), $S_{nx}=1$ corresponds to noise in which the temporal change of the frequency characteristic is non-steady and $S_{nx}=0$ corresponds to noise in which the temporal change of the frequency characteristic is steady. The noise classification circuit 2030 outputs $S_{nx}$ to the first changeover circuit 2110.

The gain $g_{exc}(j)$ (where j=0, j=0, . . . $N_{ssfr}\cdot N_{sfr}-1$) output from the excitation-signal normalizing circuit 2510, the identification flag $S_{vs}$ output from the voiced/unvoiced identification circuit 2020 and the classification flag $S_{nx}$ output from the noise classification circuit 2030 are input to the first changeover circuit 2110. The latter changes over a switch in accordance with the value of the identification flag and the value of the classification flag, thereby outputting the gain $G_{exc}(j)$ to the first filter 2150 when $S_{vs}=0$ and $S_{nx}=0$ hold, to the second filter 2160 when $S_{vs}=0$ and $S_{nx}=1$ hold and to the third filter 2170 when $S_{vs}=1$ holds.

The gain $g_{exc}(j)$ (where j=0, . . . , $N_{ssfr}\cdot N_{sfr}-1$) output from the first changeover circuit 2110 is input to the first filter 2150, which proceeds to smooth the gain using a linear or non-linear filter, adopts this as a first smoothed gain $\bar{g}_{exc,1}(j)$ and outputs to the excitation-signal reconstruction circuit 2610. Here use is made of a filter represented by Equation (24) below.

$$\bar{g}_{exc,1}(n)=r_{21}\cdot\bar{g}_{exc,1}(n-1)+(1-r_{21})\cdot g_{exc}(n) \tag{24}$$

where $\bar{g}_{exc,1}(-1)$ corresponds to $\bar{g}_{exc,1}(N_{ssfr}\cdot N_{sfr}-1)$ in the preceding frame. Further, it is assumed that $r_{21}=0.9$ holds.

The gain $g_{exc}(j)$ (where j=0, . . . , $N_{ssfr}\cdot N_{sfr}-1$) output from the first changeover circuit 2110 is input to the second filter 2160, which proceeds to smooth the gain using a linear or non-linear filter, adopts this as a second smoothed gain $\bar{g}_{exc,2}(j)$ and outputs to the excitation-signal reconstruction circuit 2610. Here use is made of a filter represented by Equation (25) below.

$$\bar{g}_{exc,2}(n)=r_{22}\cdot\bar{g}_{exc,2}(n-1)+(1-r_{22})\cdot g_{exc}(n) \tag{25}$$

$\bar{g}_{exc,2}(-1)$ corresponds to $\bar{g}_{exc,2}(N_{ssfr}\cdot N_{sfr}-1)$ in the preceding frame. Further, it is assumed that $r_{22}=0.9$ holds.

The gain $G_{exc}(j)$ (where j=0, . . . , $N_{ssfr}\cdot N_{sfr}-1$) output from the first changeover circuit 2110 is input to the third filter 2170, which proceeds to smooth the gain using a linear or non-linear filter, adopts this as a third smoothed gain $\bar{g}_{exc,3}(j)$ and outputs to the excitation-signal reconstruction circuit 2610. Here it is assumed that $\bar{g}_{exc,3}(n)=g_{exc}(n)$ holds.

FIG. 4 is a block diagram illustrating the construction of a speech signal decoding apparatus according to a fourth embodiment of the present invention. In the fourth embodiment, as shown in FIG. 4, an input terminal 50 and a second changeover circuit 7110 are added to the arrangement of the first embodiment shown in FIG. 1 and the connections are changed accordingly. The added input terminal 50 and the second changeover circuit 7110 will be described below.

A changeover control signal enters from the input terminal 50. The changeover control signal is input to the changeover circuit 7110 via the input terminal 50, and the second gain output from the second gain decoding circuit 1120 is input to the changeover circuit 7110. In accordance with the changeover control signal, the changeover circuit 7110 outputs the second gain to the second gain circuit 1130 or to the smoothing circuit 1320.

FIG. 5 is a block diagram illustrating the construction of a speech signal decoding apparatus according to a fifth embodiment of the present invention. In the fifth embodiment, as shown in FIG. 5, the input terminal 50 and the second changeover circuit 7110 are added to the arrangement of the second embodiment shown in FIG. 2 and the connections are changed accordingly. The input terminal 50 and the second changeover circuit 7110 will be described below.

A changeover control signal enters from the input terminal 50. The changeover control signal is input to the changeover circuit 7110 via the input terminal 50, and the excitation vector output from the adder 1050 is input to the changeover circuit 7110. In accordance with the changeover control signal, the changeover circuit 7110 outputs the excitation vector to the synthesis filter 1040 or to the excitation-signal normalizing circuit 2510.

FIG. 6 is a block diagram illustrating the construction of a speech signal decoding apparatus according to a sixth embodiment of the present invention. In the sixth embodiment, as shown in FIG. 6, the input terminal 50 and the second changeover circuit 7110 are added to the arrangement of the third embodiment shown in FIG. 3 and the connections are changed accordingly. The input terminal 50 and the second changeover circuit 7110 are identical with those described in the fifth embodiment of FIG. 5 and need not be described again.

The speech signal encoder in the conventional speech signal encoding/decoding apparatus shown in FIG. 8 may used as the speech signal encoder in the speech signal encoding/decoding apparatus as a seventh embodiment of the present invention.

Figure 7:
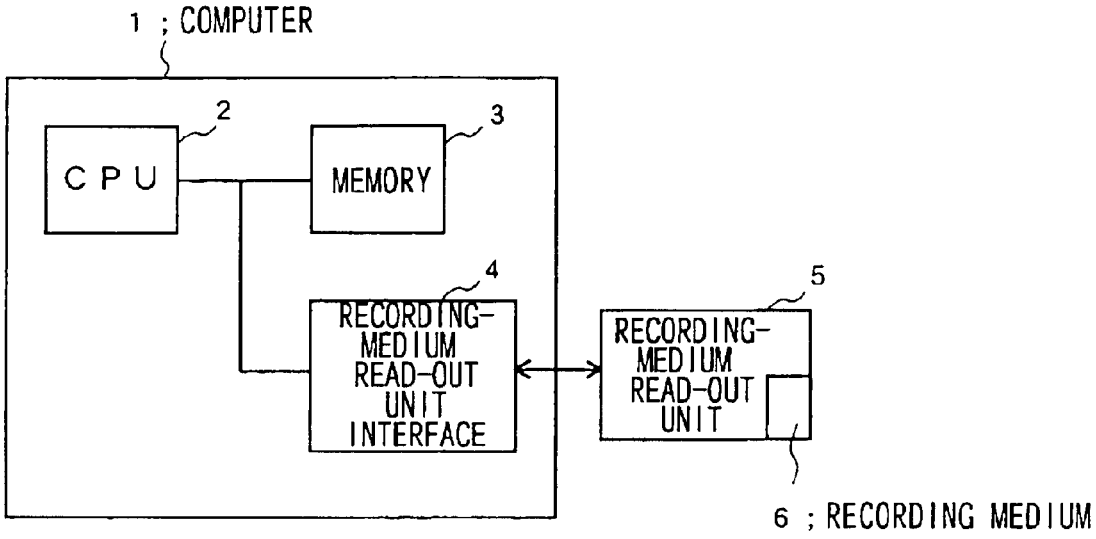
FIG. 7 is a block diagram illustrating the construction of a speech signal decoding apparatus according to an embodiment of the present invention.

The speech signal decoding apparatus in each of the foregoing embodiments of the present invention may be implemented by computer control using a digital signal processor or the like. FIG. 7 is a diagram schematically illustrating the construction of an apparatus for a case where the speech signal decoding processing of each of the foregoing embodiments is implemented by a computer in an eighth embodiment of the present invention. A computer 1 for executing a program that has been read out of a recording medium 6 executes speech signal decoding processing for decoding information concerning at least a sound source signal, gain and linear prediction coefficients from a received signal, generating an excitation signal and the linear prediction coefficients from the decoded information, and driving a filter, which is constituted by the linear prediction coefficients, by the excitation signal to thereby decode a speech signal. To this end, a program has been recorded on the recording medium 6. The program is for executing (a) processing for performing smoothing using a past value of gain and calculating an amount of fluctuation between the original gain and the smoothed gain, and (b) processing for limiting the value of the smoothed gain in conformity with the value of the amount of fluctuation and decoding the speech signal using the smoothed, limited gain. This program is read out of the recording medium 6 and stored in a memory 3 via a recording-medium read-out unit 5 and an interface 4, and the program is executed. The program may be stored in a mask ROM or the like or in a non-volatile memory such as a flash memory. Besides a non-volatile memory, the recording medium may be a medium such as a CD-ROM, floppy disk, DVD (Digital Versatile Disk) or magnetic tape. In a case where the program is transmitted by a computer from a server to a communication medium, the recording medium would include the communication medium to which the program is communicated by wire or wirelessly.

The computer 1 for executing a program that has been read out of a recording medium 6 executes speech signal decoding processing for decoding information concerning an excitation signal and linear prediction coefficients from a received signal, generating the excitation signal and the linear prediction coefficients from the decoded information, and driving a filter, which is constituted by the linear prediction coefficients, by the excitation signal to thereby decode a speech signal. To this end, a program has been recorded on the recording medium 6. The program is for executing (a) processing for calculating a norm of the excitation signal at regular intervals and smoothing the norm using a past value of the norm; and (b) processing for limiting the value of the smoothed norm using an amount of fluctuation calculated from the norm and the smoothed norm, changing the amplitude of the excitation signal in the intervals using the norm and the norm that has been smoothed and limited, and driving the filter by the excitation signal the amplitude of which has been changed.

The computer 1 for executing a program that has been read out of a recording medium 6 executes speech signal decoding processing for decoding information concerning an excitation signal and linear prediction coefficients from a received signal, generating the excitation signal and the linear prediction coefficients from the decoded information, and driving a filter, which is constituted by the linear prediction coefficients, by the excitation signal to thereby decode a speech signal. To this end, a program has been recorded on the recording medium 6. The program is for executing (a) processing for identifying a voiced segment and a noise segment with regard to the received signal using the decoded information; (b) processing for calculating a norm of the excitation signal at regular intervals in the noise segment, smoothing the norm using a past value of the norm and limiting the value of the smoothed norm using an amount of fluctuation calculated from the norm and the smoothed norm; (c) processing for changing the amplitude of the excitation signal in the intervals using the norm and the norm that has been smoothed and limited, and driving the filter by the excitation signal the amplitude of which has been changed.

Thus, in accordance with the present invention as described above, it is possible to suppress the occurrence of abnormal sound in noise segments, such sound being caused when, in the smoothing of sound source gain (second gain), the sound source gain smoothed in a noise segment takes on a value much larger than that of the sound source gain before smoothing.

The reason for this effect is that the values which the smoothed sound source gain is capable of taking on are limited on the basis of amount of fluctuation, which is calculated using the difference between smoothed sound source gain and the sound source gain before smoothing, in such a manner that sound source gain that has been smoothed in a noise interval will not take on a very large value in comparison with the sound source gain before smoothing. The entire disclosure of References 1, 2, 3 and 4 is herein incorporated by reference thereto as the components and/or processings making up parts of the present invention, as far as these relate to the implementation of the present invention. The same applies to the disclosure of Reference 5.

As many apparently widely different embodiments of the present invention can be made without departing from the spirit and scope thereof, it is to be understood that the invention is not limited to the specific embodiments thereof except as defined in the appended claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A speech signal decoding method for decoding information concerning at least a sound source signal, gain and linear prediction coefficients from a received signal, generating an excitation signal and linear prediction coefficients from decoded information, and driving a filter, which is constituted by the linear prediction coefficients, by the excitation signal to thereby decode a speech signal, comprising:

smoothing the gain using a past value of the gain;

limiting the value of the smoothed gain based upon an amount of fluctuation calculated from the gain and the smoothed gain; and decoding the speech signal using the gain that has been smoothed and limited.

2. The method according to claim 1, wherein the amount of fluctuation is represented by dividing an absolute value of a difference between the gain and the smoothed gain by the gain, and the value of the smoothed gain is limited in such a manner that the amount of fluctuation will not exceed a predetermined threshold value.

3. The method according to claim 1, wherein switching between use of the gain and use of the smoothed gain is performed in accordance with an entered switching control signal when the speech signal is decoded.

4. A speech signal encoding and decoding method comerising the steps of:

encoding an input speech signal by expressing the input speech signal by an excitation signal and linear prediction coefficients; and performing decoding by the speech signal decoding method set forth in claim 1.

5. A program product comprising a program for causing said computer to execute decoding by the speech signal decoding method set forth in claim 1, when an input speech signal has been encoded by expressing the input speech signal by an excitation signal and linear prediction coefficients.

6. A speech signal decoding method for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal, comprising:

deriving a norm of the excitation signal at regular intervals;

smoothing the norm using a past value of the norm;

limiting the value of the smoothed norm based upon an amount of fluctuation calculated from the norm and the smoothed norm;

changing the amplitude of the excitation signal in said intervals using said norm and the norm that has been smoothed and limited; and driving the filter by the excitation signal the amplitude of which has been changed.

7. The method according to claim 6, wherein the amount of fluctuation is represented by dividing an absolute value of a difference between the norm and the smoothed norm by the norm, and the value of the smoothed norm is limited in such a manner that the amount of fluctuation will not exceed a predetermined threshold value.

8. The method according to claim 6, wherein the excitation signal in said intervals is divided by the norm in said intervals and the quotient is multiplied by the smoothed norm in said intervals to thereby change the amplitude of the excitation signal.

9. The method according to claim 6, wherein switching between use of the excitation signal and use of the excitation signal the amplitude of which has been changed is performed in accordance with an entered switching control signal when the speech signal is decoded.

10. A speech signal encoding and decoding method comprising the steps of:

encoding an input speech signal by expressing the input speech signal by an excitation signal and linear prediction coefficients; and performing decoding by the speech signal decoding method set forth in claim 6.

11. A program product comprising a program for causing said computer to execute decoding by the speech signal decoding method set forth in claim 6, when an input speech signal has been encoded by expressing the input speech signal by an excitation signal and linear prediction coefficients.

12. A speech signal decoding method for decoding information concerning an excitation signal and linear prediction coefficients from a received signal, generating the excitation signal and the linear prediction coefficients from the decoded information, and driving a filter, which is constituted by the linear prediction coefficients, by the excitation signal to thereby decode a speech signal, comprising:

identifying a speech segment and a noise segment with regard to the received signal using the decoded information;

deriving a norm of the excitation signal at regular intervals in the noise segment;

smoothing the norm using a past value of the norm;

limiting the value of the smoothed norm based upon an amount of fluctuation derived from the norm and the smoothed norm;

changing the amplitude of the excitation signal in said intervals using the norm and the norm that has been smoothed and limited; and driving the filter by the excitation signal the amplitude of which has been changed.

13. The method according to claim 12, wherein the amount of fluctuation is represented by dividing an absolute value of a difference between the norm and the smoothed norm by the norm, and the value of the smoothed norm is limited in such a manner that the amount of fluctuation will not exceed a predetermined threshold value.

14. The method according to claim 12, wherein the excitation signal in said intervals is divided by the norm in said intervals and the quotient is multiplied by the smoothed norm in said intervals to thereby change the amplitude of the excitation signal.

15. The method according claim 12, wherein switching between use of the excitation signal and use of the excitation signal the amplitude of which has been changed is performed in accordance with an entered switching control signal when the speech signal is decoded.

16. A speech signal encoding and decoding method comprising the steps of:

encoding an input speech signal by expressing the input speech signal by an excitation signal and linear prediction coefficients; and performing decoding by the speech signal decoding method set forth in claim 12.

17. A program product comprising a program for causing said computer to execute decoding by the speech signal decoding method set forth in claim 12, when an input speech signal has been encoded by expressing the input speech signal by an excitation signal and linear prediction coefficients.

18. A speech signal decoding apparatus for decoding information concerning at least a sound source signal, gain and linear prediction coefficients from a received signal, generating an excitation signal and linear prediction coefficients from the decoded information, and driving a filter, which is constituted by the linear predictions coefficients, by the excitation signal to thereby decode a speech signal, comprising:

a smoothing circuit smoothing the gain using a past value of the gain; and a smoothing-quantity limiting circuit limiting the value of the smoothed gain based upon an amount of fluctuation calculated from the gain and the smoothed gain.

19. The apparatus according to claim 18, wherein the amount of fluctuation is represented by dividing an absolute value of a difference between the gain and the smoothed gain by the gain, and the value of the smoothed gain is limited in such a manner that the amount of fluctuation will not exceed a predetermined threshold value.

20. The apparatus according to claim 18, wherein the apparatus comprises a switching circuit in which switching between use of the gain and use of the smoothed gain is performed in accordance with an entered switching control signal when the speech signal is decoded.

21. A speech signal encoding and decoding apparatus comprising:

a speech signal encoder encoding an input speech signal by expressing the input speech signal by an excitation signal and linear prediction coefficients; and the speech signal decoding apparatus set forth in claim 18.

22. A speech signal decoding apparatus for decoding information concerning an excitation signal and linear prediction coefficients from a received signal, generating the excitation signal and linear prediction coefficients from the decoded information, and driving a filter, which is constituted by the linear prediction coefficients, by the excitation signal to thereby decode a speech signal, comprising:

an excitation-signal normalizing circuit deriving a norm of the excitation signal at regular intervals and dividing the excitation signal by the norm;

a smoothing circuit smoothing the norm using a past value of the norm;

a smoothing-quantity limiting circuit limiting the value of the smoothed norm based upon an amount of fluctuation calculated from the norm and the smoothed norm; and an excitation-signal reconstruction circuit multiplying the smoothed and limited norm by the excitation signal to thereby change the amplitude of the excitation signal in said intervals.

23. The apparatus according to claim 22, wherein the amount of fluctuation is represented by dividing the absolute value of the difference between the norm and the smoothed norm by the norm, and the value of the smoothed norm is limited in such a manner that the amount of fluctuation will not exceed a predetermined threshold value.

24. The apparatus according to claim 22, wherein the apparatus comprises a switching circuit in which switching between use of the excitation signal and use of the excitation signal the amplitude of which has been changed is performed in accordance with an entered switching control signal when the speech signal is decoded.

25. A speech signal encoding and decoding apparatus comprising:

a speech signal encoder encoding an input speech signal by expressing the input speech signal by an excitation signal and linear prediction coefficients; and the speech signal decoding apparatus set forth in claim 22.

26. A speech signal decoding apparatus for decoding information concerning an excitation signal and linear prediction coefficients from a received signal, generating the excitation signal and linear prediction coefficients from the decoded information, and driving a filter, which is constituted by the linear prediction coefficients, by the excitation signal to thereby decode a speech signal, comprising:

a voiced/unvoiced identification circuit identifying a speech segment and a noise segment with regard to the received signal using the decoded information;

an excitation-signal normalizing circuit deriving a norm of the excitation signal at regular intervals and dividing the excitation signal by the norm;

a smoothing circuit smoothing the norm using a past value of the norm;

a smoothing-quantity limiting circuit limiting the value of the smoothed norm based upon an amount of fluctuation calculated from the norm and the smoothed norm; and an excitation-signal reconstruction circuit multiplying the smoothed and limited norm by the excitation signal to thereby change the amplitude of the excitation signal in said intervals.

27. The apparatus according to claim 26, wherein the amount of fluctuation is represented by dividing the absolute value of the difference between the norm and the smoothed norm by the norm, and the value of the smoothed norm is limited in such a manner that the amount of fluctuation will not exceed a predetermined threshold value.

28. The apparatus according to claim 26, wherein the apparatus comprises a switching circuit in which switching between use of the excitation signal and use of the excitation signal the amplitude of which has been changed is performed in accordance with an entered switching control signal when the speech signal is decoded.

29. A speech signal encoding and decoding apparatus comprising:

a speech signal encoder encoding an input speech signal by expressing the input speech signal by an excitation signal and linear prediction coefficients; and the speech signal decoding apparatus set forth in claim 26.

30. A program product for causing a computer to execute processing (a) and (b) below, wherein the computer constitutes a speech signal decoding apparatus for decoding information concerning at least a sound source signal, gain and linear prediction coefficients from a received signal, generating an excitation signal and linear prediction coefficients from the decoded information, and driving a filter, which is constituted by the linear prediction coefficients, by the excitation signal to thereby decode a speech signal;

(a) a process for performing smoothing using a past value of a gain and calculating an amount of fluctuation between the gain and a smoothed gain; and (b) a process for limiting the value of the smoothed gain in conformity with the value of the amount of fluctuation and decoding the speech signal using the smoothed, limited gain.

31. The program product according to claim 30, wherein said program product comprises a program for a process of representing the amount of fluctuation by dividing an absolute value of a difference between the gain and the smoothed gain by the gain, and limiting the value of the smoothed gain in such a manner that the amount of fluctuation will not exceed a predetermined threshold value.

32. The program product according to claim 30, wherein said program product comprises a program switching between use of the gain and use the smoothed gain in accordance with an entered switching control signal when the speech signal is decoded.

33. A program product for causing a computer to execute processing (a) to (c) below, wherein the computer constitutes a speech signal decoding apparatus for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal:

(a) calculating a norm of an excitation signal at regular intervals and smoothing the norm using a past value of the norm;

(b) limiting the value of the smoothed norm in conformity with the value of an amount of fluctuation calculated from the norm and the smoothed norm; and (c) changing the amplitude of the excitation signal in said intervals using the norm and the norm that has been smoothed and limited, and driving the filter by the excitation signal the amplitude of which has been changed.

34. The program product according to claim 33, wherein said program product comprises a program to execute a process of representing the amount of fluctuation by dividing an absolute value of a difference between the norm and the smoothed norm by the norm, and limiting the value of the smoothed norm in such a manner that the amount of fluctuation will not exceed a predetermined threshold value.

35. The program product according to claim 33, wherein said program product comprises a program dividing the excitation signal in said intervals by the norm in said intervals and multiplying the quotient by the smoothed norm in said intervals to thereby change the amplitude of the excitation signal.

36. The program product according to claim 33, wherein said program product comprises a program switching between use of the excitation signal and use of the excitation signal the amplitude of which has been changed in accordance with an entered switching control signal when the speech signal is decoded.

37. A program product for causing a computer to execute processing (a) to (d) below, wherein the computer constitutes a speech signal decoding apparatus for decoding information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal:

(a) identifying a speech segment and a noise segment with regard to a received signal using decoded information;

(b) calculating a norm of an excitation signal at regular intervals in the noise segment and smoothing the norm using a past value of the norm;

(c) limiting the value of the smoothed norm in conformity with an amount of fluctuation calculated from the norm and the smoothed norm; and (d) changing the amplitude of the excitation signal in said intervals using the norm and the norm that has been smoothed and limited, and driving the filter by the excitation signal the amplitude of which has been changed.

38. The program product according to claim 37, wherein said program product comprises a program representing the amount of fluctuation by dividing an absolute value of a difference between the norm and the smoothed norm by the norm, and limiting the value of the smoothed norm in such a manner that the amount of fluctuation will not exceed a predetermined threshold value.

39. The program product according to claim 37, wherein said program product comprises a program dividing the excitation signal in said intervals by the norm in said intervals and multiplying the quotient by the smoothed norm in said intervals to thereby change the amplitude of the excitation signal.

40. The program product according to claim 37, wherein said program product comprises a program switching between use of the excitation signal and use of the excitation signal the amplitude of which has been changed in accordance with an entered switching control signal when the speech signal is decoded.

41. A speech signal decoding apparatus comprising:

(a) a code input circuit splitting code of a bit sequence of an encoded input signal that enters from an input terminal, converting the code to indices that correspond to a plurality of decode parameters, outputting an index corresponding to a line spectrum pair, termed hereinafter "LSP", which represents the frequency characteristic of the input signal, to an LSP decoding circuit, outputting an index corresponding to a delay that represents a pitch period of the input signal to a pitch signal decoding circuit, outputting an index corresponding to a sound source vector comprising a random number or a pulse train to a sound source signal decoding circuit, outputting an index corresponding to a first gain to a first gain decoding circuit, and outputting an index corresponding to a second gain to a second gain decoding circuit;

(b) an LSP decoding circuit, to which the index output from said code input circuit is input, and which reads the LSP corresponding to the input index out of a table which stores LSPs corresponding to indices, obtains an LSP in a subframe of the present frame and outputs the LSP;

(c) a linear prediction coefficient conversion circuit, to which the LSP output from said LSP decoding circuit is input, and which converts the LSP to linear prediction coefficients and outputs the coefficients to a synthesis filter;

(d) a sound source signal decoding circuit, to which the index output from said code input circuit is input, and which reads a sound source vector corresponding to the index out of a table storing sound source vectors corresponding to indices, and outputs the sound source vector to a second gain decoding circuit;

(e) a second gain decoding circuit, to which the index output from said code input circuit is input, and which reads a second gain corresponding to the input index out of a table storing second gains corresponding to indices, and outputs the second gain to a smoothing circuit;

(f) a second gain circuit, to which a first sound source vector output from said sound source signal decoding circuit and the second gain are input, and which multiplies the first sound source vector by the second gain to generate a second sound source vector and outputs the generated second sound source vector to an adder;

(g) a memory circuit holding an excitation vector input thereto from said adder and outputting a held excitation vector, which was input thereto in the past, to a pitch signal decoding circuit;

(h) a pitch signal decoding circuit, to which the past excitation vector held by said memory circuit and the index output from said code input circuit are input, with said index specifying a delay, and which cuts out vectors of samples corresponding to a vector length from a point previous to the starting point of the present frame by an amount corresponding to the delay to thereby generate a first pitch vector, and outputs the first pitch vector to a first gain circuit;

(i) a first gain decoding circuit, to which the index output from said code input circuit is input, and which reads a first gain corresponding to the input index out of a table storing first gains corresponding to indices, and outputs the first gain to a first gain circuit;

(j) a first gain circuit, to which the first pitch vector output from said pitch signal decoding circuit and the first gain output from said first gain decoding circuit are input, and which multiplies the input first pitch vector by the first gain to generate a second pitch vector, and outputs the generated second pitch vector to said adder;

(k) an adder, to which the second pitch vector output from said first gain circuit and the second sound source vector output from said second gain circuit are input, and which calculates the sum of these inputs, and outputs the sum to a synthesis filter as an excitation vector;

(l) a smoothing coefficient calculation circuit, to which LSP output from said LSP decoding circuit is input, and which calculates average LSP in the present frame, finds the amount of fluctuation of the LSP with respect to each subframe, finds a smoothing coefficient in the subframe, and outputs the smoothing coefficient to a smoothing circuit;

(m) a smoothing circuit, to which the smoothing coefficient output from said smoothing coefficient calculation circuit and the second gain output from said second gain decoding circuit are input, and which finds an average gain from the second gain in the subframe, and outputs the second gain;

(n) a synthesis filter, to which the excitation vector output from said adder and the linear prediction coefficients output from said linear prediction coefficient conversion circuit are input, and which drives a synthesis filter, for that the linear prediction coefficients have been set, by the excitation vector to thereby calculate a reconstructed vector, and outputs the reconstructed vector from an output terminal; and (o) a smoothing-quantity limiting circuit, to which the second gain output from said second gain decoding circuit and the smoothed second gain output from said smoothing circuit are input, and which finds the amount of fluctuation between the smoothed second gain output from said smoothing circuit and the second gain output from said second gain decoding circuit, outputs the smoothed second gain to said second gain circuit as is when the amount of fluctuation is less than a predetermined threshold value, replaces the smoothed second gain with a smoothed second gain limited in terms of values it is capable of taking on when the amount of fluctuation is equal to or greater than the threshold value, and outputs this smoothed second gain to said second gain circuit.

42. The apparatus according to claim 41, further comprising:

(p) an excitation-signal normalizing circuit, to which an excitation vector in a subframe output from said adder is input, and which calculates gain and a shape vector from the excitation vector every subframe or every sub-subframe obtained by subdividing a subframe, outputs the gain to said smoothing circuit, and outputs the shape vector to an excitation-signal reconstruction circuit; and (q) an excitation-signal reconstruction circuit, to which the gain output from said smoothing-quantity limiting circuit and the shape vector output from said excitation-signal normalizing circuit are input, and which calculates a smoothed excitation vector, and outputs this excitation vector to said memory circuit and to said synthesis filter;

(r) wherein said smoothing circuit has the output of said excitation-signal normalizing circuit input thereto instead of the output of said second gain decoding circuit and has the output of said smoothing coefficient calculation circuit input thereto;

(s) said smoothing-quantity limiting circuit has the smoothed gain output from said smoothing circuit applied to one input terminal thereof and has the gain output from said excitation-signal normalizing circuit, rather than the output of said second gain decoding circuit, applied to the other input terminal thereof, finds the amount of fluctuation between the smoothed gain output from said smoothing circuit and the gain output from said excitation-signal normalizing circuit, supplies the smoothed gain as is to said excitation-signal reconstruction circuit when the amount of fluctuation is less than a predetermined threshold value, replaces the smoothed gain with a smoothed gain limited in terms of values it is capable of taking on when the amount of fluctuation is equal to or greater than the threshold value, and supplies this smoothed gain to the excitation-signal reconstruction circuit; and (t) the output of said second gain decoding circuit is input to said second gain circuit as second gain.

43. The apparatus according to claim 42, further comprising:

a power calculation circuit, to which the reconstructed vector output from said synthesis filter is input, and which calculates the sum of the squares of the reconstructed vector and outputting the power to a voiced/unvoiced identification circuit;

a speech mode decision circuit, to which a past excitation vector held by said memory circuit and an index specifying a delay output from said code input circuit are input, and which calculates a pitch prediction gain in a subframe from the past excitation vector and the delay, determines a predetermined threshold value with respect to the pitch prediction gain or with respect to an in-frame average value of the Pitch prediction gain in a certain frame, and sets a speech mode;

a voiced/unvoiced identification circuit, to which an LSP output from said LSP decoding circuit, the speech mode output from said speech mode decision circuit and the power output from said power calculation circuit are input, and which finds the amount of fluctuation of a spectrum parameter, identifying a speech segment and noise segment based upon the amount of fluctuation, and outputs amount-of-fluctuation information and an identification flag;

a noise classification circuit, to which the amount-of-fluctuation information and identification flag output from said voice/unvoiced identification are input, and which classifies noise and outputting a classification flag; and a first changeover circuit, to which the gain output from said excitation-signal normalizing circuit, the identification flag output from said voiced/unvoiced identification circuit and the classification flagoutput from the noise classification circuit are input, and which changes over a switch in accordance with a value of the identification flag and a value of the classification flag to thereby switchingly output the gain to any one of a plurality of filters having different filter characteristics from one another;

wherein the filter selected from among said plurality of filters has the gain output from said first changeover circuit applied thereto, smoothes the gain using a linear filter or non-linear filter and outputs the smoothed gain to said smoothing-quantity limiting circuit as a first smoothed gain; and said smoothing-quantity limiting circuit has the first smoothed gain output from the selected filter applied to one input terminal thereof, has the output of said excitation-signal normalizing circuit applied to the other input terminal thereof, finds the amount of fluctuation between the gain output from said excitation-signal normalizing circuit and the first smoothed gain output from said selected filter, uses the first smoothed gain as is when the amount of fluctuation is less than a predetermined threshold value, replaces the first smoothed gain with a smoothed gain limited in terms of values it is capable of taking on when the amount of fluctuation is equal to or greater than the threshold value, and supplies this smoothed gain to said excitation-signal reconstruction circuit.

44. The apparatus according to claim 41, further comprising a changeover circuit switching between a mode of using of the gain and a mode of using the smoothed gain as the input to said second gain circuit in accordance with a switching control signal, which has entered from an input terminal, when the speech signal is decoded.

45. The apparatus according to claim 42, further comprising a changeover circuit to which the excitation vector output from said adder is input, and which outputs the excitation vector to said synthesis filter or to said excitation-signal normalizing circuit in accordance with a changeover control signal, that has entered from an input terminal.

46. The apparatus according to claim 43, further comprising a changeover circuit to which the excitation vector output from aid adder is input, and which outputs the excitation vector to said synthesis filter or to said excitation-signal normalizing circuit in accordance with a changeover control signal, that has entered from an input terminal.

47. A speech signal decoding method for decoding information concerning at least a sound source signal, gain and linear prediction coefficients from a received signal, generating an excitation signal and linear prediction coefficients from decoded information, and driving a filter, which is constituted by the linear prediction coefficients, by the excitation signal to thereby decode a speech signal, comprising:

smoothing the gain using a past value of the gain;

limiting the value of the smoothed gain based upon the gain prior to the smoothing and the smoothed gain; and decoding the speech signal using the gain that has been smoothed and limited.

48. A speech signal decoding method for decoding Information concerning an excitation signal and linear prediction coefficients from a received signal, generating an excitation signal and linear prediction coefficients from the decoded information, and driving a filter, which is constituted by the linear prediction coefficients, by the excitation signal to thereby decode a speech signal, comprising:

deriving a norm of the excitation signal at regular intervals;

smoothing the norm using a past value of the norm;

limiting the value of the smoothed norm based upon the smoothed norm and the norm prior to the smoothing;

changing the amplitude of the excitation signal in said intervals using said norm and the norm that has been smoothed and limited; and driving the filter by the excitation signal the amplitude of which has been changed.

* * * * *